US010464198B1

(12) United States Patent
Steidtmann

(10) Patent No.: US 10,464,198 B1
(45) Date of Patent: Nov. 5, 2019

(54) HAMMER WITH LIGHTWEIGHT HANDLE

(71) Applicant: David Edward Steidtmann, St. Louis, MO (US)

(72) Inventor: David Edward Steidtmann, St. Louis, MO (US)

( * ) Notice: Subject to any disclaimer, the term of this patent is extended or adjusted under 35 U.S.C. 154(b) by 319 days.

(21) Appl. No.: 15/450,100

(22) Filed: Mar. 6, 2017

Related U.S. Application Data

(60) Provisional application No. 62/304,223, filed on Mar. 6, 2016.

(51) Int. Cl.
*B25D 1/12* (2006.01)
*B25D 1/04* (2006.01)

(52) U.S. Cl.
CPC ..... *B25D 1/12* (2013.01); *B25D 1/045* (2013.01)

(58) Field of Classification Search
CPC ... B25D 1/00; B25D 1/04; B25D 1/06; B25D 1/045; B25D 1/12; B25G 1/00; B25G 1/01; B25G 1/02; B25G 1/10
See application file for complete search history.

(56) References Cited

U.S. PATENT DOCUMENTS 2,788,815 A * 4/1957 D Aoust ..... B25D 1/06 7/901
4,347,883 A 9/1982 Fariss, Jr.
4,561,635 A * 12/1985 Lamansky ..... B25D 1/04 254/26 R
5,211,669 A 5/1993 Bonnes
6,311,369 B1 11/2001 Ryu
6,405,616 B1 6/2002 Chen
6,467,376 B1 10/2002 Wu
6,536,308 B1 * 3/2003 Thorne ..... B25D 1/02 81/20
8,104,379 B2 1/2012 Hanlon
8,534,643 B2 9/2013 Lombardi
8,833,207 B2 9/2014 Hanlon
2002/0112572 A1 * 8/2002 Pimentel ..... B25G 1/01 81/20
2014/0238201 A1 8/2014 Pimentel
(Continued)

OTHER PUBLICATIONS

Stiletto TiBone TBII-15 [online]. Stiletto Tools. Retrieved from the Internet on Feb. 23, 2017 <URL:http://stiletto.com/>.
(Continued)

*Primary Examiner* — Tyrone V Hall, Jr.
(74) *Attorney, Agent, or Firm* — Creativenture Law, LLC; Dennis JM Donahue, III; Kevin Staed

(57) ABSTRACT

A hammer has a head connected to a lightweight handle with a center of gravity that is proximate to the head of the hammer and separated from the base of the handle by 85%-95% of the total hammer length, measured from the base of the handle to the top side of the head. The handle weight is between 10%-20%. Accordingly, the lighter handle allows the center of gravity of the hammer to be within 85%-95% of the total hammer length from the base of the handle while maintaining a comfortable head weight between 14 oz. and 25 oz. The hammer also has inflection point proximate to the base of the handle providing multiple gripping sections to allow a user to grip the handle in different locations and at different gripping angles that move relative to the longitudinal axis of the hammer.

20 Claims, 18 Drawing Sheets

(56) References Cited

U.S. PATENT DOCUMENTS

2015/0068366 A1* 3/2015 Lombardi ..... B25G 1/10
81/20

OTHER PUBLICATIONS

Stiletto Airgrip "Coldshrink" Handle Grip Wrap Tube [online]. Stiletto Tools. Retrieved from the Internet on Feb. 23, 2017 <URL:www.stiletto.com/p-2-8-airgrip-coldshrink-handle-grip-wrap-tube.aspx>.

DeWalt DWHT51054—20 oz. One-Piece Steel Hammer [online]. DeWalt/Stanley Black & Decker, Inc. Retrieved from the Internet on Mar. 6, 2017 <URL:www.dewalt.com/products/hand-tools/hammers-and-pry-bars/20-oz-onepiece-steel-hammer/dwht51054>.

* cited by examiner

HAMMER WITH LIGHTWEIGHT HANDLE

CROSS-REFERENCE TO RELATED APPLICATIONS

This application claims priority to U.S. Provisional Patent Application Ser. No. 62/304,223 filed on Mar. 6, 2016, which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to striking tools, and more particularly to light weight hammer handles that are made of layered composite materials.

Related Art

Hammers are well known for driving and prying nails and are used both commercially by framers, roofers and construction workers as well as in non-commercial settings for various uses. Generally, hammers are made up a head attached to the end of a handle which can be grasped by a user and swung to hit and drive a nail, stake, or similar fastener into a desired position. Accordingly, the functionality of hammers has largely remained unchanged where the earliest hammers satisfactorily accomplished the intended job. However, there exists a problem in the industries where tradespeople repeatedly use hammers at their worksites; traditional hammers result in repetitive stress injuries to approximately 30% of the workers (ref. Werner R A, Franzblau A, Gell N, et al. Predictors of persistent elbow tendonitis among auto assembly workers. J. Occup. Rehabil. 2005; 15(3):393-400). Contact stress and force are known concerns for workers (ref. Occupational Safety and Health Administration, US Department of Labor. Computer Workstations eTool, Contact Stress, Force. Accessed Nov. 29, 2012—www.osha.gov/SLTC/etools/computerworkstations/more.html). One of the injuries suffered by these tradespeople is lateral epicondylitis, also called tennis or carpenter's elbow, and this injury is caused by the repeated shock caused by the transference of energy from the handle to the worker's hand, wrist and elbow during the hammering motion, especially the shock at the end of the hammering motion when the head of the hammer strikes the head of a nail. Accordingly, there exists a need in the art for a handle capable of reducing the amount of shock to the worker's hand, wrist and elbow at the end of the hammering motion.

There have been a number of modifications made to traditional hammers in an effort to reduce the shock imparted to the worker. For example, regardless of the type of material being used for handles, many manufacturers have added one or more layers of a resilient, dampening material over the gripping portion of the handle's base section where the worker would grasp and swing the hammer for the most forceful head strikes. While these layers may be effective in reducing vibrations, the vibrations tend to be either so small in amplitude or high enough in frequency that they are simply absorbed by the skin in the hand and do not cause tendon injuries. Accordingly, eliminating the sinusoidal oscillations of the handle after impact is an ineffective answer to the wrong problem. Different from vibration is a mechanism called impact shock or recoil shock, where a single high velocity object must be stopped quickly. The transfer of momentum from the moving object to the stopping object is impact shock. In the case of hammers, the moving object is the handle immediately after impact with the nail, and the stopping object is the user's hand, wrist, forearm, elbow and upper arm. As will become evident from the description of the present invention, the addition of this material at the distal end of the handle could actually be more counterproductive to reducing stress because of the increased weight that the material adds to the handle as well as the corresponding movement of the hammer's center of gravity further away from the head toward the base of the handle.

Hammer manufacturers have also used different handle materials, including hickory (or other wood), steel, aluminum, fiberglass, polycarbonate and other plastics, composites, and even titanium. Some manufacturers suggest that the materials of their handles provide better shock protection. For example, a manufacturer of titanium tools advertises that its hammers with titanium handles have ten (10) times less recoil shock than steel hammers. It may be true that titanium dampens vibrations ten (10) times greater than high carbon steel, but this does not necessarily result in an equivalent reduction in recoil shock as felt by the worker. As will become evident from the description of the present invention, it is the mass in the handle that must be stopped by the user's hand and the mass is independent of the material from which it comes. Other manufacturers have varied the weight of the hammer head, some increasing the head weight to provide a greater impact force while others have reduced the head weight to change the hammer's weight distribution to make the hammer less top heavy and allow for increased swing speed to increase kinetic energy, such as explained in U.S. Pat. No. 8,534,643, and manufacturers have changed the weight of the handle to varying degrees. Some of these changes in weights may reduce the shock imparted to the worker and may alleviate the repeated stress injuries, but no prior art hammer design has been optimized based on the operation of the hammer as the head impacts a nail head. To perform such an optimization, the problem of recoil shock is rethought from a different perspective, keeping the same or better the impact energy at the head while minimizing the energy transferred from the handle to the worker's hand during the impact, and what results can be a very different picture of the hammer's design.

The head is at the end of the hammer away from the worker's hand on the grip of the handle, and the center of gravity (CG) of the hammer is typically located away from the grip toward the head between approximately three-quarters (¾) and four-fifths (⅘) of the total length of the hammer. In operation, the head of a hammer stops very quickly on the head of the nail, but the handle is only constrained from further movement by the worker's hand. Therefore, the further away from the head that the CG is located towards the base of the handle, the more shock will be felt by the worker because, although the head stops on the nail head, the handle still has kinetic energy that must be stopped by the worker's hand, and this energy is transferred through the handle to the worker's hand. High speed videography shows the shock applied to a worker's hand following the head strike: the head is stopped and the handle's momentum carries it in the direction of the swing after the impact causing the handle to rotate around the impact point on the nail head. There is a resulting yank or jerking applied to the worker's hand by the handle because of the inertia of the handle's mass, and the further away that the CG is from the head, the more shock will be felt by the worker. Additionally, even without linear kinetic motion the effect of CG location is substantial. For example, if the hammer swing is purely rotational around the user's hand the hammer will impact the fastener causing the head to stop. However, the CG still has momentum which is transferred to the base of the handle and subsequently into the user's arm as the hammer pivots around the contact point.

As described above, following the head striking the nail head, the worker's hand, wrist, and elbow stops the rotation of the handle. Since the handle is in motion, the worker's hand must apply a force to the handle to decelerate it; force is dependent on the mass and the deceleration (F=ma). To reduce the force, the deceleration of the handle can be slowed or the mass of the handle can be reduced. Practically, reducing the deceleration is counter-productive because the hammer would be swung with less velocity which reduces the effectiveness of the head strike and then requires more swings and strikes. Accordingly, for a given head weight, a lighter mass handle could be installed; a lighter handle would have an additional benefit of shifting the CG away from distal end of the handle where the worker grips the hammer toward the head of the hammer. Since the head is stopped on the nail head following the strike and the handle's momentum produces the rotation around the nail head, there is a torque with the nail head acting as a fulcrum, and moving the location of the CG towards the head increases the lever arm, thereby increasing the mechanical advantage of the handle and decreasing the force required to stop the handle.

In currently manufactured hammers, the handles are heavy relative to the head of the hammer and typically weigh between nearly one half (½) and three quarters (¾) of the weight of the head, with some handles weighing as much as or more than the head. Accordingly, hammers have handle weights that account for approximately one quarter (¼) of the hammer weight, and typically account for more than one third (⅓) of the total hammer weight and may even be around one half (½) of the total weight. For a given head weight, the larger the weight of the handle relative to the head, the higher the shock to the worker following the impact of the head. Once the relationship between the operation of the hammer and the shock to the worker is recognized, with the continued momentum and torque of the handle around the nail head where the hammer head is stopped, it can then be recognized that there is a significant benefit to reducing the weight of the handle for a given head weight so that the energy transferred to the worker's hand following the head strike and corresponding shock is reduced.

Some current hammers are designed to have a lighter weight handle. However, current handle weights are still too heavy to effectively reduce the shock and repetitive stress injuries caused by the amount of energy transferred from the handle to the worker's hand. As described in the present invention, even the lightest weight handles are more than twice as heavy as they should be to effectively reduce the energy being transferred. Even with the most recent, innovative hammer designs, the designers are following the same practices of adding weight to the handle section for one reason or another. For example, in the '643 Patent referred to above, it is suggested that a softer material should be placed over the gripping portion, and according to the weight distribution design of this hammer, the handle weighs nearly as much as the head or weighs more than the head. Other designs that use hollow metal shells, such as in US Pat. Pub. No. 2014/0238201, result in handle weights that are less than the weight of the head but are at best equivalent to standard hickory handles. As another example, U.S. Pat. No. 8,104,379 and as related patent, U.S. Pat. No. 8,833,207, disclose hammers with a composite handle, but the handle also includes a titanium plate that spans the entire length of the handle in order to improve strength, resist torque, and reduce vibrations. Accordingly, the '379 Patent and the '207 Patent are additional examples of innovative hammer designs that still distribute the weight in the traditional manner, with the handles weighing between nearly one half (½) and three quarters (¾) of the weight of the head. Numerous other hammers have disclosed various shock absorbing structures to help reduce the shock imparted to the worker swinging the hammer. Although there have been efforts to reduce the vibrations and shock imparted to a worker, no prior art hammer has sought to reduce the handle weight sufficiently relative to the head weight and move the CG sufficiently close to the head that the shock imparted to the worker is significantly reduced. Instead, current hammer designs, even those that are innovative, maintain the traditional distribution of weight between the head and handle. Additionally, it is desirable to have a hammer that is as light as possible to lighten the load of a worker's tool belt when the hammer is not being used.

Other types of tools may have a head at the end of an elongated handle which is grasped with two hands such as shovels, rakes, hoes, spades and forks. As compared with the single-handed grasp of a hammer handle or other tool designed for striking, the handles of these double-handed tools are designed for actions other than striking. Accordingly, these double-handed tools are not typically concerned with the weight of the handle or any shock imparted to the worker through the handle and are primarily concerned with the strength of the handle. An example of a double-handed handle is disclosed in U.S. Pat. No. 5,211,669 and includes a composite handle with support-bearing core, preferably wood, but may also be a foam or a shaped honeycomb material. There are some types of hammers that have very large heads, such as sledgehammers, and some sledgehammers can have short handles which may result in a CG location that is relatively close to the head. However, these sledgehammers do not have the smaller diameter striking face that is required by hammers which must have accuracy in striking nail heads without bending the nails or damaging the material into which the nails are being driven. These nails may also be driven in very confined geometries such as tie connectors or certain framing and remodeling applications that would not fit a sledgehammer. Additionally, sledgehammers are not typically swung with the repetitiveness of nail-striking hammers so there had been no reason to consider the relative CG location in striking hammers as compared with the CG location in sledgehammers.

Hammers are also used by many different types of tradespeople and certain handle shapes are more conducive to particular uses. Many framers favor a curved, axe handle shape that puts the extension of the center axis of the grip well behind the head/handle joint. This is extremely useful when hammering nails sideways at your feet with tremendous force, as is common in modern stick building construction. Additionally, a straight handle is preferred for light carpentry, siding installation, finishing applications, and precision work since the centerline of the grip aligns with the head/handle joint or is slightly forward thereof in a third embodiment. Accordingly, there is a problem in the art where a tradesperson needs multiple hammers for each particular job. For example, there are no known hammers that combine an axe handle, straight handle, and precision handle. Conventional axe handles are sometimes called a curved handle or hatchet handle and have a curved section and a straight section, such as described in '201 Patent Application referred to above. However, the straight section is at a position proximate to the hammer head rather than the handle base. Accordingly, the effective length of the handle is shortened because the user is required to grip the straight section closer to the head, and the hammer becomes less efficient. Since a conventional handle is mostly straight and then curves down into the axe shape, the curved part can hit the wall that the user is nailing. Given this problem, there is also need in the art for a single hammer that has multiple gripping sections with different angles relative to longitudinal axis of the handle, capable of being effectively used for different jobs.

Known hammers also have improved striking faces, including malleable striking faces that partially deform when striking a surface. In fact, in the early days of copper and bronze tools all hammers had malleable striking faces. Only with hardened steel striking faces have traditional hammers moved away from malleable striking faces. But even with the advance of technology, malleable striking faces still have a place in the hammer repertoire. However, these malleable striking faces are not typically used to absorb shock but instead are used to prevent a sparking oxidation reaction when the hammer is used in environments where sparks could prove dangerous. Additionally, many deformable materials used in striking faces, like silicon bronze and aluminum bronze are slippery enough that they are also used as a bearing material in other inventions.

Accordingly, these deformable materials are not typically used as a solution to preventing nails from slipping off the striking face of a hammer head primarily because a malleable surface works best in a very narrow range of parameters, namely a very hard blow substantially in line with the axis of the nail. For impacts that fall within this range of parameters the striking surface material deforms and prevents the hammer from slipping off the nail. Additionally, the deformation process keeps the hammer in contact with the nail slightly longer, which delivers more energy to the nail. However, if the blow is at an angle, the slippery material causes the hammer to slide off the nail. For this reason, a machined surface on the striking face, sometimes called a milled face, or a waffle face, is universally more popular for preventing hammer slip. However, these machined faces have some substantial disadvantages as they tend to wear out and become less effective until they eventually have to be replaced. For most hammers, this means replacing the entire hammer or simply using the hammer in an ineffective condition. Additionally, the machining leaves obvious imprints on the wood when a nail is either missed or sunk flush with the wood. Although this may not be a disadvantage in framing hammers since framing wood is typically not exposed, it does limit the applicability of the hammer where the builder must switch hammers when working on materials that might be visible. Accordingly, there exists a desire in the art to have a long lasting, universally applicable malleable striking face that does not leave impact imprints and is capable of keeping the striking face on the nail head longer while overcoming the slipping problem if the hammer is not swung with enough force.

Of course, a higher amount of energy is transferred to the nail if the striking face stays in contact with the nail for a longer period of time during impact. This effect is used successfully in the golf industry with deforming, "spring face" technology on driver faces. Although there is an equivalent idea with a hammer striking face, the different impact forces make applying an appropriate spring face to hammers difficult. For example, nail setting is a much softer blow than nail driving. Similarly, sinking a 16d nail in 2×4 construction lumber in a production setting calls for tremendous force but installing siding with a 10d nail takes a more subtle touch. Another limitation is that the deforming face spring effect only works when the nail is struck very nearly dead center on the striking face as off center hits significantly reduce the effectiveness of a deforming spring face. Accordingly, there is a desire in the art to have a hammer that effectively uses a spring face to promote more efficient transfer of energy between the impact face and nail.

Another aspect commonly seen in hammers are nail pulling features like a claw on the opposite end of the head as the striking face. Additionally, other hammers have nail pull features on the side of the hammer head. However, there is still a desire in the art to have a hammer head with a nail pull feature that offers a significant mechanical advantage over existing hammers. Additionally, there is a desire in the art for a nail pull feature capable of removing longer nails that traditional claws and singular nail pulls have trouble removing.

SUMMARY OF THE INVENTION

A hammer having a head connected to a handle that may be grasped and swung by a user to drive a nail, stake or similar fastener and made from a strong and lightweight composite material like polymer reinforced composite fiber, carbon fiber, fiberglass, Kevlar, and aramid weaves. The hammer head has a striking face used for striking the fastener, a claw end opposite the striking face and an end face separating the two. The handle is attached to the head at a position opposite the end face and extends away from the end face of the head to a handle base. Accordingly, the first longitudinal axis of the head extends the head length between the circular striking face and the end of the hammer's claw and is perpendicular to the second longitudinal axis of the handle extending between the base of the handle and the end face of the head. Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

An aspect of the hammer invention is a center of gravity that is proximate to the end face of the head. The center of gravity is separated from the base of the handle by 85%-95% of the total hammer length, measured between the base of the handle and the end face of the head. Because the center of gravity is proximate to the head, the majority of the weight of the hammer is targeted to the striking face which promotes easier use and better striking.

Another aspect of the present invention is a handle weight ($WT_{H}A$) that is at most 20% of total hammer weight ($WT_{TOT}$) but is preferably between 10%-20%. Because the weight of the handle is lighter relative to the entire weight of the hammer, the center of gravity is closer to the head. Conversely, traditional hammers have handle weights that makeup greater than 25% of total hammer weight. Accordingly, the heavier handles contribute to greater shock and prevent the center of gravity of the hammer from being within 85%-95% of the total hammer length from the base of the handle while maintaining a comfortable head weight ($WT_{HD}$) between fourteen ounces (14 oz.≈396 g) and twenty-five ounces (25 oz.≈708 g). The light weight handle is made from a single layer of composite material that may be reinforced with additional composite material layers in areas that experience high stress when the hammer is swung and impacts a surface. Additionally, these composite layers are formed around an internal core that is preferably made of foam. However, the core itself is does not provide any strength or structural support once the composite is hardened, thus the internal core may be hollow or made from some other non-structural material.

Another aspect of the present invention is a handle having an inflection point proximate to the base of the handle to provide multiple gripping sections. In effect, the inflection point allows a user to grip the handle in different locations and at different gripping angles that move relative to the longitudinal axis of the hammer. The inflection point is intended to be within 5 diameters of the striking face from the base of the handle. Accordingly, the multiple gripping positions and axes are proximate to the base of the handle. Thus, the user does not necessarily need to grip the handle at a position significantly closer to the head, and thereby sacrifice leverage when accomplishing varying tasks, as seen in the prior art.

Another aspect of the invention is the interface between the mounting end of the handle and the head. In the preferred embodiment, the head and handle are attached through the set screw and the reinforcing block. The set screw extends through a threaded hole in the front plate of the head and embeds in at least a portion of the front side of the composite handle's mounting end. Additionally, the reinforcing block is held within the mounting end of the handle and provides support to the thin carbon fiber layer into which the set screw compresses.

Another aspect of the head of the present invention is a double nail-pull made up of a pair of notches on opposite sidewalls of the head, slightly offset from the side of the handle. The first notch engages the head of the nail and a user may rotate a portion of the nail of out the wall, board or similar surface to first position. Subsequently, the head of the hammer can be repositioned into a second position where the second notch engages the head of the nail and the first notch engages the shank of the nail. Accordingly, the hammer can again be rotated about the nail-pull and the nail can be completely pulled out of the wall, board or similar surface. This is particularly useful for fully removing the long nails typically used in framing at high levels of mechanical advantage.

Another aspect of the head of the present invention is a malleable striking face imbedded with the grit materials. This striking face is made up of a plug made from a deformable metal into which hard particles are embedded. In operation, when the striking face hits a fastener, like the head of a nail, with sufficient force the striking face will deform around the struck surface and thereby prevent the striking face from sliding off. Additionally, repeated impacts on the deformable material kneads the surface of the striking face, burying some of the hard particles and exposing others which provide a textured striking face that further prevents nail slide.

BRIEF DESCRIPTION OF THE DRAWINGS

The present invention will become more fully understood from the detailed description and the accompanying drawings. The drawings constitute a part of this specification and include exemplary embodiments of the invention, which may be embodied in various forms. It is to be understood that in some instances, various aspects of the invention may be shown exaggerated or enlarged to facilitate an understanding of the invention; therefore the drawings are not necessarily to scale. In addition, in the embodiments depicted herein, like reference numerals in the various drawings refer to identical or near identical structural elements.

DETAILED DESCRIPTION OF THE PREFERRED EMBODIMENTS

The following description of the preferred embodiment(s) is merely exemplary in nature and is in no way intended to limit the invention, its application, or uses.

Figure 2C:
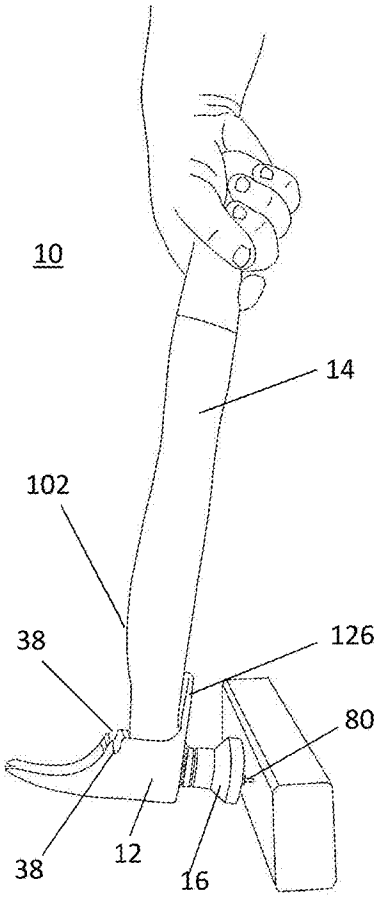
FIGS. 2B and 2C are perspective views of the inventive hammer in FIG. 2A.
Figure 2B:
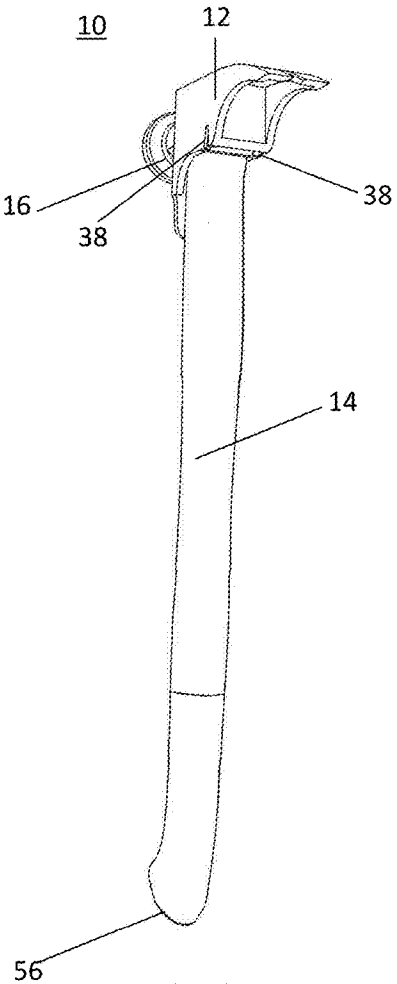
Figure 2A:
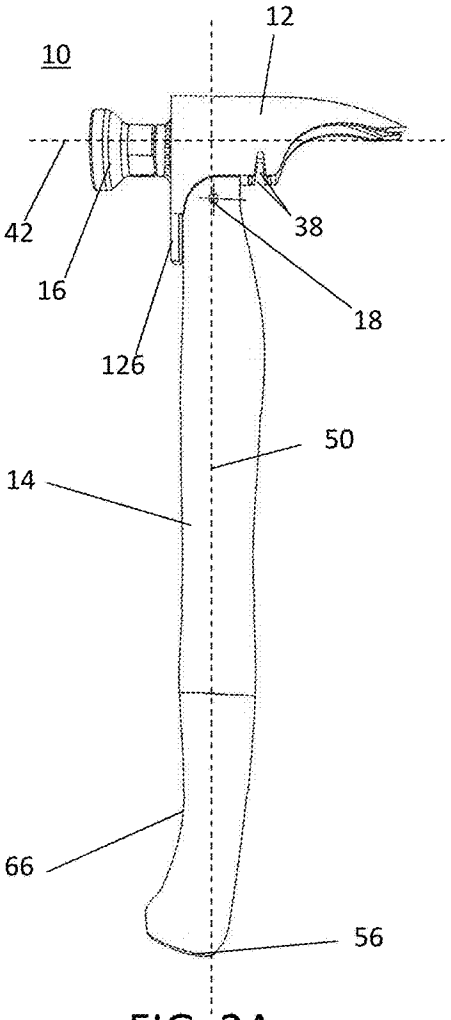
FIG. 2A is a side view of a hammer according to the present invention with a lightweight handle and a center of gravity proximate to the head.

As illustrated in FIGS. 2A-2C, a hammer 10 has a head 12 that is connected to a handle 14. The handle may be grasped and swung by a user to drive a nail 80, stake or similar fastener and is lightweight, preferably being made from a strong and lightweight composite material like polymer reinforced composite fiber, carbon fiber, fiberglass, Kevlar, and aramid weaves. The hammer head 12 has a striking face 16 used for striking the fastener 80, a claw end 86 opposite the striking face and a head length 44 separating the claw and striking face. The handle is attached to the head at a position opposite the end face 48 and extends away from the head's end face 46*a* to a handle base 56. The head's longitudinal axis 42 extends between the circular striking face and the end of the hammer's claw and is substantially perpendicular to the handle's longitudinal axis 50 extending between the base of the handle and the end face of the head. The handle has a mounting end 74 opposite from the base, and in the preferred embodiment the mounting end is at least partially disposed within the head of the hammer. The mounting end may be secured to the head by a variety of fasteners 36 that may include but is not limited to a set screw 36*a*, wedge fit 36*b*, a wedge fastener 36*c*, star nut 36*d*, clamp fit 36*e*, epoxy or other adhesives 36*f* or a combination thereof, such as shown in FIGS. 6 and 7.

The head 12 is connected to the handle 14 at a side opposite the end face 48 through the head void 94 and in the preferred embodiment houses at least a portion of the handles mounting end 74*a* as shown in FIG. 6. The striking face has a preferred diameter 60 of 1.5 inches (1.5 in.≈3.81 cm) but may vary so long as the diameter is less than 1.5 times the maximum lateral dimension 52 of the handle. The head length 44 extends from the striking face to the opposite end of the head which may include a claw portion 86. The handle's longitudinal axis is substantially parallel to the plane of the striking face. The head and handle combine to produce a total hammer length 20 between a base of the handle and the end face of the head that is between thirteen inches (13 in.≈33 cm) and twenty inches (20 in.≈51 cm).

An aspect of the hammer 10 invention is a center of gravity (CG) 18 that is proximate to the end face 46*a* of the head 12. The CG is located away from the base 56 of the handle 14 by a distance that is 85%-95% of the total hammer length 20 ($L_{Tot}$), measured between the base of the handle and the end face of the head. Because the CG is proximate to the head, the majority of the weight of the hammer is targeted to the striking face 16 which promotes easier use and better striking. The inventive hammer's CG is closer to the head than previously considered by or possible in the prior art, and by positioning the hammer's CG even closer to the head and further away from the base of the handle, the inventive hammer reduces the amount of shock delivered down the entire handle, ultimately reducing the chance of injury to the user.

Figure 12B:
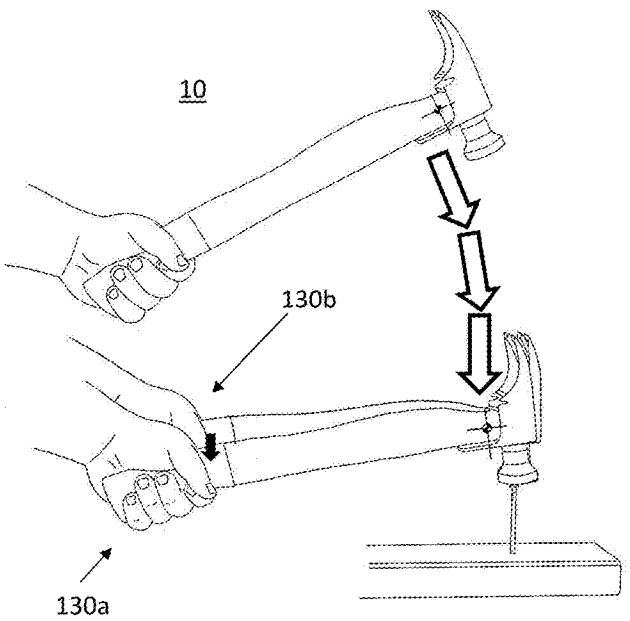
FIG. 12B is sequential view of the inventive hammer swung and striking a nail.
Figure 12A:
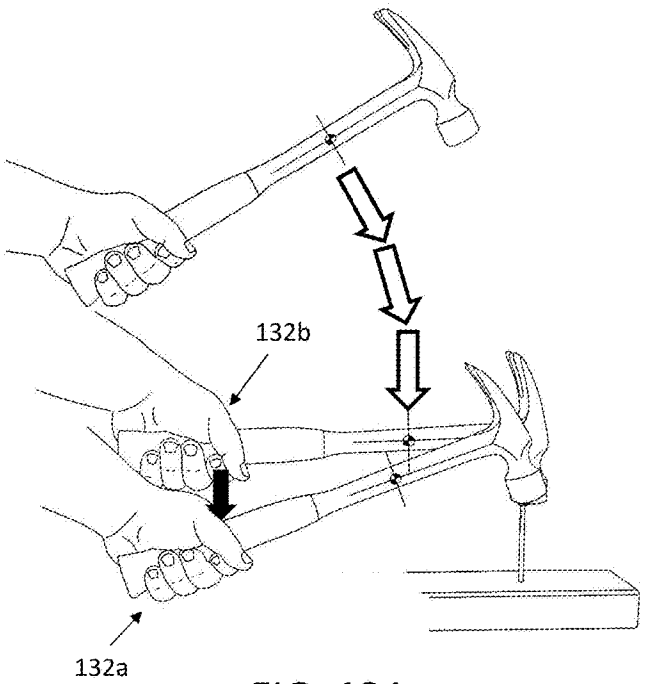
FIG. 12A PRIOR ART
FIG. 12A is a sequential view of a prior art hammer swung and striking a nail.

As shown in FIG. 12*b*, placing the CG very nearly behind the striking face causes the majority of the swing force to be transmitted to the nail, and very little swing force remains in the handle which is much lighter than the head, reducing the counteracting force that the hand 130*a* must apply to the handle when the nail is impacted at 130*b*. Conversely, as seen in FIG. 12A, in prior art hammers, the handles are heavier than in the present invention and the hammer CG is located further away from the head so when the head strikes the nail, there is more energy in the movement of the handle that must be counteracted by the person's hand. Accordingly, in the prior art hammers, the counteracting force that the hand 132*a* must apply to the handle when the nail is impacted at 132*b* is significantly greater than the force 130*a* required when the nail is impacted 130*b* by the hammers according to the present invention. The different levels of counteracting force are shown in the drawings with different sized arrows, and it will be appreciated that without the increased force applied by the hand of the user with the prior art handles, the distance in which the handle would continue to rotate around the nail would be greater than with the hammers of the present invention, and this is also shown in the drawings, Additionally, when the head strikes the nail, the nail serves as a fulcrum so the closer that the CG is to the user's hand and further away from the fulcrum nail, the less mechanical advantage there is to the lever arm between the user's hand and the CG. Accordingly, in the present invention, shifting the location of the CG towards the head increases the lever arm, thereby increasing the mechanical advantage of the handle and further decreasing the force required to stop the handle. In comparison, in the prior art hammers, the hammer's CG is further from head which decreases the lever arm, thereby decreasing the mechanical advantage of the handle and further increasing the force that is necessary to stop the heavier prior art handles. Generally, more energy is delivered to the hand and more shock must be absorbed with the prior art hammers with heavier handles and CG locations further from the head as compared with the present invention. It is the force on the user's hand at impact that causes injury. Therefore, by reducing the weight of the handle and shifting the center of gravity towards the head, the present invention reduces the shock felt by the user through the handle as compared to prior art hammers.

Another aspect of the present invention is a handle weight ($Wt_{Ha}$) that is less than 20% of total hammer weight ($Wt_{Tot}$), preferably between 10%-20%. Because the weight of the handle is lighter relative to the entire weight of the hammer, the center of gravity 18 is closer to the head 12. Conversely, traditional hammers have handle weights that makeup greater than 25% of total hammer weight. These heavier handles contribute to greater shock and prevent the center of gravity of the hammer from being located as close to the head as in the present invention while maintaining a comfortable head weight ($Wt_{Hd}$) between fourteen (14 oz.≈396 g) and twenty-five ounces (25 oz.≈708 g). Examples of prior art hammers and their centers of gravity can be seen in FIGS. 1A, 1B and 1C. Additionally, as the mounting end 74 of the handle is contained within a void in the head 94, at least of a portion of the handle contributes to the head weight.

In the present invention, the effective weight of the handle is further reduced where the heaviest part of the handle is held within the head when mounted. Accordingly, the center of gravity 18 of the entire hammer 10 is moved closer to the head 12. The lightweight handle is made from layers of composite material 26, including the internal layer or layers 26*a*, that preferably extend the entire length of the handle, the external layer or layers 26*b* that also extend the entire length of the handle, with reinforcing in intermediate layers 26*c* in areas that experience high stress when the hammer is swung and impacted. Additionally, these composite layers are formed around a non-structural internal core 32 that is preferably made of foam 32*a*. However, the core itself does not provide any strength or structural support once the composite is hardened, thus the internal core 32 may be hollow 32*b* or made from some other non-structural material. Conversely, internal cores described in the prior art are designed to provide structural support, such as the support-bearing core disclosed in U.S. Pat. No. 5,211,669. In the present handle, the internal core is not a support-bearing core, providing insufficient tensile strength or impact strength to serve as a hammer handle without the composite layers surrounding the core. Accordingly, in the handle of the present invention, the handle support is produced by the multiple composite layers and not by the core. Accordingly, the handle 14 is designed to maximize strength and stiffness while reducing mass. The carbon fiber and Kevlar layers, and possibly alternative layers such as fiberglass, are the only structural components and are designed to provide adequate strength during use so that other materials such as aluminum, metal, plastic, titanium or wood are not needed.

Another aspect of the present invention is an inflection point 24 in the handle 14 proximate to the base 56 of the handle to provide multiple gripping sections 96. In effect, the inflection point 24 allows a user to grip the handle in different locations and at different gripping angles 98 that rotate relative to the longitudinal axis 50 of the hammer as shown in FIG. 4. The inflection point 24 is a relatively short distance ($d_{IP}$) from the base of the handle 56, the distance being less than five (5) times the diameter ($D_{SF}$) of the striking face 60, preferably less than four (4) times the diameter ($d_{IP}<4\times D_{SF}$). Accordingly, the multiple gripping sections 96 and axes 98 are proximate to the base of the handle. With the innovative curvature and inflection point of the present invention, if the user wants to change gripping angles for a particular application, the user can still grip the handle close to the base 56 and does not need to grip the handle at a position significantly closer to the head 12 as would be necessary with prior art handles which sacrifice leverage. Accordingly, the inflection point 24 provides a curved power section 96*a* for framers with a power gripping axes 98*a* between 10°-20° behind the longitudinal axis 50 of the handle, a 96*b* neutral gripping section having neutral axes 98*b* substantially parallel with the longitudinal axis 50 of the handle, and a precision gripping section 96*c* for finishing work with a precision gripping axes 98*c* between 5°-10° in front of the longitudinal axis 50 of the handle. These gripping sections 96 are proximate to the base of the handle which provides better swinging leverage as compared to the prior art. Further, as shown in FIG. 4, the user's knuckles are in relatively the same position but by holding the handle in different places, the orientation of the hammer changes relative to the gripping hand.

In addition to the light weight handle, the head 12 includes a number of inventive features. The preferred head uses a welded box construction with a head void 94 and has replaceable striking faces 16 that attach to a set screw 36*a* which also holds the handle 14 onto the head 12 as described below in the preferred embodiment. Both the handle and striking face can be easily replaced in the field with common tools and a variety of striking faces can be attached to the hammer head for different building applications. For example, a textured face can be used for framing and heavy construction, a smooth face can be used for lighter, finish carpentry, while a plastic face can be used for non-marring or non-sparking applications. Additionally, the head has a traditional rip claw 86 for pulling nails and prying boards, but also features a double nail-pull 38 with two notches 76*a*, 76*b* on opposite sidewalls 78 for high-leverage nail pulling.

Figure 14A:
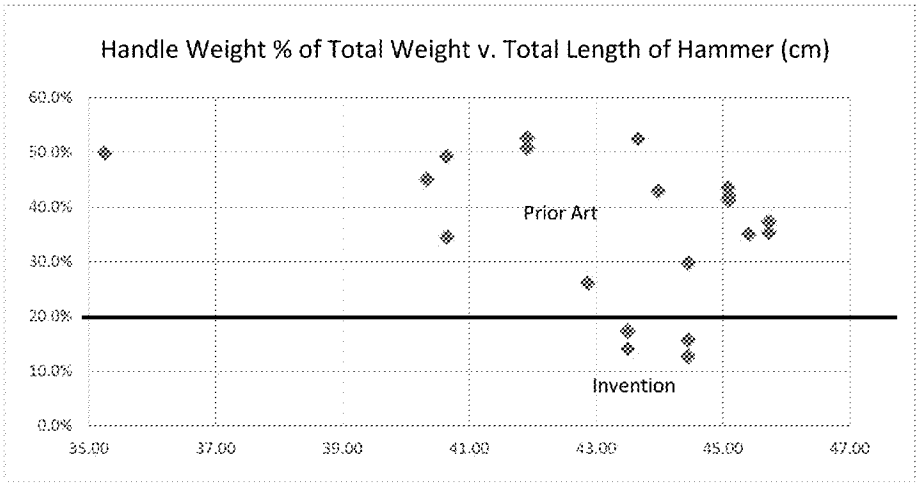
FIGS. 14A and 14B are graphs plotting the handle weight relative to the total hammer weight and comparing the inventive hammer with prior art hammers.
Figure 14B:
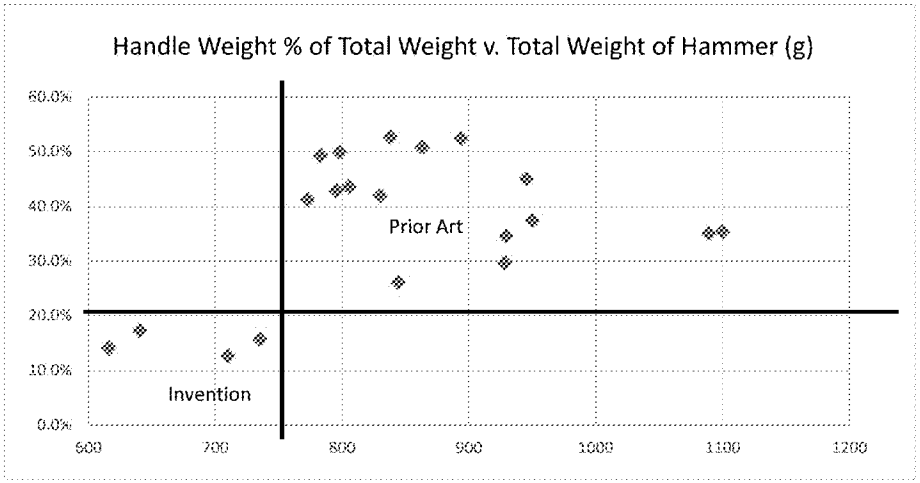
Figure 15A:
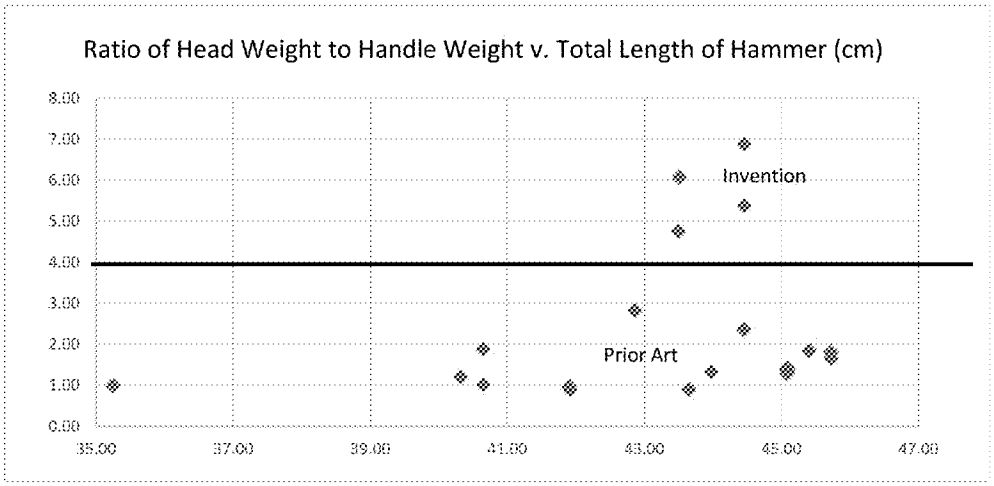
FIGS. 15A and 15B are graphs plotting the ratio of the handle weight to head weight and comparing the inventive hammer with prior art hammers.
Figure 15B:
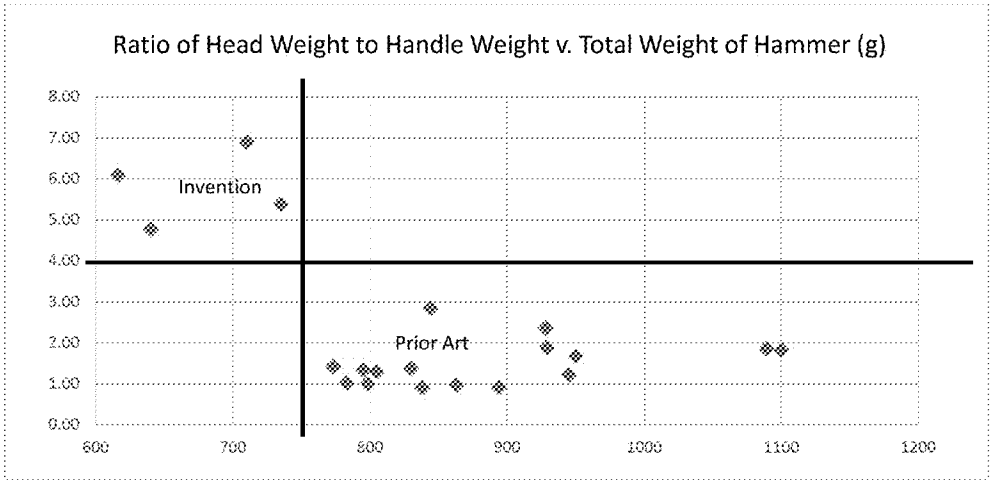

As generally explained above, in the present invention, the hammer's CG 18 is very close to the end face 46*a* of the head 12 and may actually be within the head section. In particular, the CG is located away from the base of the handle 56 by approximately 85%-95% of the total hammer length 20. To shift the CG closer to the head 12, it is an aspect of the present invention to have a hammer handle 14 significantly lighter than the prior art such that the handle itself is between 10%-20% of the total hammer weight. Additionally, the ratio between the head weight and handle weight of the present invention is greater than the highest ratio found in the prior art. Table I below and FIGS. 13-15 document weight, length and CG measurements for the hammer 10 according to the present invention as compared with prior art hammers.

TABLE I

Hammer Measurements

| Hammer Brand/ Handle Material | Total Weight (g) | Head Weight (g) | Handle Weight (g) | Hammer Length (cm) | CG Location as % of Hammer Length |
|---|---|---|---|---|---|
| Tool Driven Framer (hollow core)/ Carbon Fiber/Kevlar | 616 | 529 (M) | 87 | 43.50 | 87.9% |
| Tool Driven Builder (hollow core)/ Carbon Fiber/Kevlar | 710 | 620 (M) | 90 | 44.45 | 88.9% |
| Tool Driven Framer (foam core)/ Carbon Fiber/Kevlar | 640 | 529 (M) | 111 | 43.50 | 88.1% |
| Tool Driven Builder (foam core)/ Carbon Fiber/Kevlar | 735 | 620 (M) | 115 | 44.45 | 89.1% |
| Stiletto Ti-bone/ Titanium | 894 | 425 (A) | 469 | 43.66 | 67.3% |
| Stiletto 14P/ Polycarbonate | 783 | 397 (A) | 386 | 40.64 | 70.7% |
| Estwing 22S/ Steel | 945 | 519 (M) | 426 | 40.32 | 73.2% |
| Estwing Big Blue/ Steel | 1089 | 708 (A) | 381 | 45.40 | 74.1% |
| DeWalt 15 Old/ Steel - I-Beam | 863 | 425 (A) | 438 | 41.91 | 69.5% |
| DeWalt 15 New/ Steel Stamped | 838 | 397 (M) | 441 | 41.91 | 68.2% |
| DeWalt 17 S/ Hickory Straight | 830 | 481 (A) | 349 | 45.09 | 80.3% |
| DeWalt 17 C/ Hickory - Curved | 844 | 624 (M) | 220 | 42.86 | 81.5% |
| DeWalt 20/ Steel | 798 | 400 (A*) | 398 | 35.24 | 69.4% |
| Powerstrike Curved/ Aluminum | 795 | 454 (A) | 341 | 43.97 | 80.1% |
| Powerstrike Straight W/Aluminum + Wrap | 773 | 454 (A) | 319 | 45.09 | 79.6% |
| Powerstrike Straight/ Aluminum | 805 | 454 (A) | 351 | 45.09 | 78.2% |
| Vaughan 23/ Hickory | 928 | 652 (A) | 276 | 44.45 | 81.8% |
| Husky 21/ Hickory | 950 | 595 (A) | 355 | 45.72 | 79.2% |

TABLE I-continued

| Hammer Measurements | | | | | |
|---|---|---|---|---|---|
| Hammer Brand/ Handle Material | Total Weight (g) | Head Weight (g) | Handle Weight (g) | Hammer Length (cm) | CG Location as % of Hammer Length |
| Vaughan 21/ Fiberglass | 929 | 608 (M) | 321 | 40.64 | 76.2% |
| Hart 21/ Fiberglass | 1100 | 711 (M) | 389 | 45.72 | 76.4% |

For the data in Table I above, the total weight of the hammers were measured on a single scale and are displayed in grams. In regards to the head weight, some of the prior art hammers did not have removable heads and were made of materials that did not easily facilitate the removal the head of the hammer from the handle. Accordingly, the head weights are followed by an "A" indicating that manufacturer's advertised head weight was used. For example, the Husky 21 hickory handle has an advertised head weight of twenty-one ounces (21 oz.≈595 g), as indicated in Table I above. Conversely, heads easily separable from the handle were individually weighed and indicated in Table I with an "M." Additionally, the "A*" indicates the DeWalt 20 steel hammer having an advertised head weight of twenty ounces (20 oz.≈567 g) but an estimated head weight of fourteen ounces (14 oz.≈400 g). This estimate is based on DeWalt's advertised claim that this hammer is an "Optimal Weight Distribution" hammer which is defined in Black & Decker's U.S. Pat. No. 8,534,643 as a weight distribution spread almost equally between the head and the handle of the hammer. Accordingly, the estimated head weight of 400 grams gives a weight distribution between the head weight and handle weight of approximately 1:1, matching the optimal weight distribution as advertised and indicated with "A*". Subsequently, the handle weight was calculated by subtracting the head weight from the total weight and the hammer length was measured from the top face of the head to the base of the handle in centimeters. Lastly, the location of the CG for each hammer was determined and is reflected in Table I as a percentage of the entire length measured from the base of the handle.

Figure 1A:
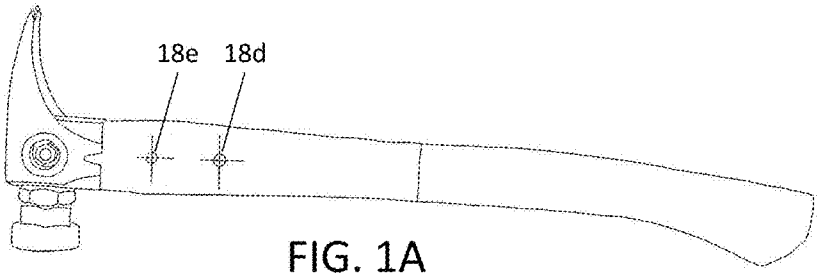
FIG. 1A PRIOR ART
FIGS. 1A-1C illustrate three types of prior art hammers having center gravity closer to the handle base than the present invention.
Figure 1B:
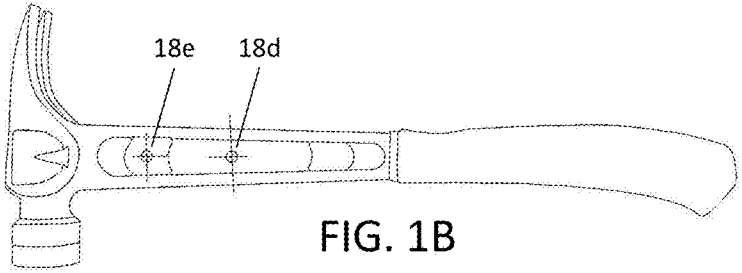
FIG. 1B PRIOR ART
Figure 1C:
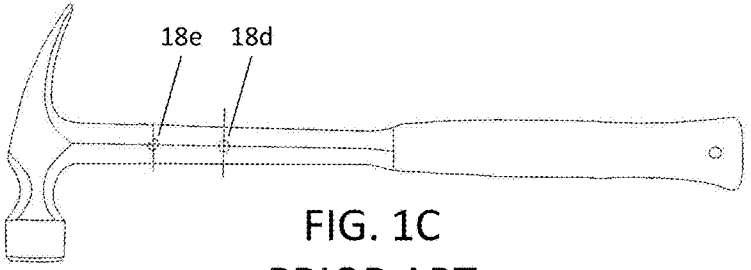
FIG. 1C PRIOR ART
Figure 13A:
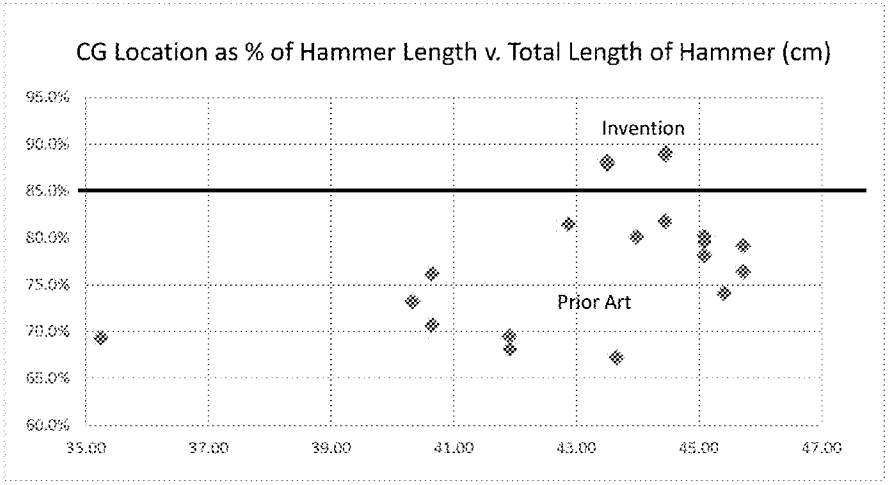
FIGS. 13A and 13B are graphs plotting the center of gravity and comparing the inventive hammer with prior art hammers.
Figure 13B:
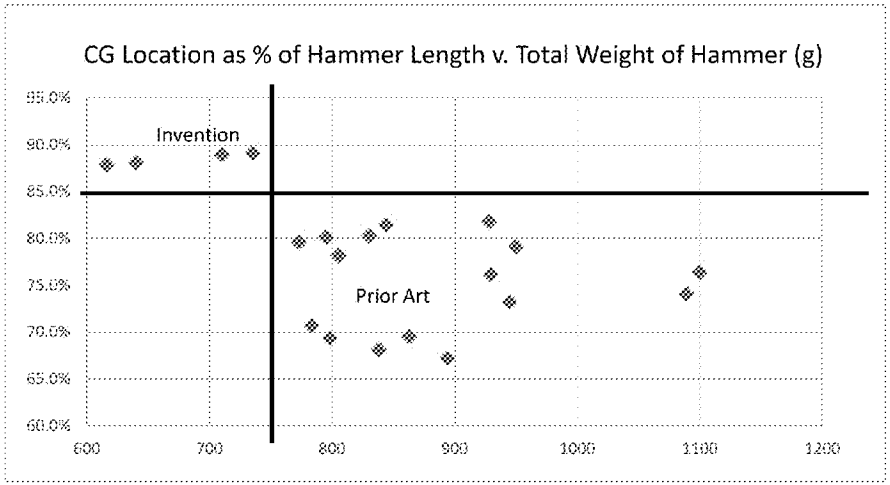

As illustrated in FIGS. 13A and 13B, embodiments of the present invention have a CG location that is greater than 85% of the total hammer length away from the base of the handle, preferably between 85% and 95%. The CG location for the present invention is plotted with the data for the prior art hammers relative to both the total length of the hammer, illustrated in FIG. 13A, and the total weight of the hammer, illustrated in FIG. 13B. As evident from Table I above and the charts in FIGS. 13A and 13B, the hammer CGs for prior art hammers are mostly located at 75%±5% of the total hammer length, and the location of the hammer CG for the prior art hammers is less than 82% of the total hammer length. FIGS. 1A, 1B, and 1C show the approximate 70%-75% location 18*d* as well as the approximate 82% location 18*e*.

To have a center of gravity proximate to the head, the weight of the handle is reduced to 10%-20% of the total weight of the hammer. Accordingly, the head weighs substantially more than the handle, and the CG consequently is shifted closer to the head and further away from the handle base. Hammers of the type documented in Table I have a total weight under 1.5 kg, with most being between 0.75 kg and 1.0 kg, with the present invention having a total hammer weight under 0.75 kg due to the lightweight handle. According to the present invention, the handle weight may vary between 0.075 kg and 0.15 kg depending on the length of the handle and the types of materials that are used. In comparison, the handles of the prior art hammers are all over 0.2 kg, with most handles weighing between 0.3 kg and 0.5 kg. Accordingly, the handle of the present invention is not only substantially lighter than the prior art handles, it contributes a smaller percentage to the overall weight of the hammer and ultimately results in an overall lighter hammer with the same head weight as the prior art hammers.

Figure 3A:
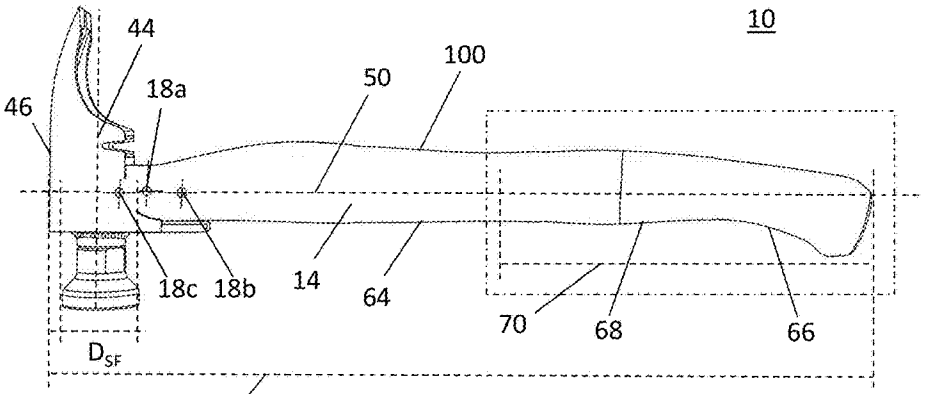
FIG. 3A is a side view of the inventive hammer with a range of GC locations.

As explained above and shown in FIG. 3A, the hammer's CG 18*b* according to the present invention is located more than 85% of the hammer's total length from the handle end to the head. This CG location 18*b* corresponds to more than 90% of the handle's length, and is preferably greater than 95% of the handle length 18*a*. The CG location can even be beyond the end of the handle length (>100%), such as when the hammer's CG is actually within the head section of the hammer 18*c*. The handle length is defined as the distance between the extreme end of the handle at the gripping end and a plane perpendicular to the longitudinal axis of the handle that is tangent to the circumference of the striking face at its nearest point to the gripping end.

As documented in Table II below, the handle weight of the present invention is below 20% of the total weight of the handle. This relative weight of the handle to the total weight of the hammer is plotted relative to the total length of the hammer in FIG. 14A and the total weight of the hammer in FIG. 14B. The low handle weight percentage is maintained while also having a total hammer length and weight that is comparable to the prior art and preferably between 35 and 47 centimeters and 600 and 1200 grams as documented in Table I and respectively shown in FIGS. 14A and 14B. Accordingly, it is another aspect of the present invention to have a handle weight that is between 10%-20% of the total weight of the entire hammer. In the preferred embodiment, the handle weight is between 12%-18% of the total weight but this preferred embodiment is not intended to be limiting as the weight of the handle will vary depending on the hammer length and types of materials used to construct the handle.

While the total weight of the inventive hammer is comparable to the prior art hammer weights, inasmuch as they are all significantly less than the weight of sledgehammers and are typically more than a specialty lightweight tacking hammers, the lightweight handle of the present invention clearly results in a hammer with a weight that heretofore has not been achieved or even considered. According to the present invention, the total hammer weight is lighter than the prior art hammers by a measure that is equal to the differential in the weights of the handles as shown in Table I and illustrated in FIGS. 13B, 14B, 15B, and 16B.

TABLE II

| Comparison of Handle Weight to Total Hammer Weight & Handle Weight | | |
|---|---|---|
| Hammer Brand/ Handle Material | Handle Weight % of Total Weight | Ratio of Head Weight to Handle Weight |
| Tool Driven Framer (hollow core)/ Carbon Fiber/Kevlar | 14.1% | 6.08 |
| Tool Driven Builder (hollow core)/ Carbon Fiber/Kevlar | 12.7% | 6.89 |

TABLE II-continued

| Comparison of Handle Weight to Total Hammer Weight & Handle Weight | | |
|---|---|---|
| Hammer Brand/ Handle Material | Handle Weight % of Total Weight | Ratio of Head Weight to Handle Weight |
| Tool Driven Framer (foam core)/ Carbon Fiber/Kevlar | 17.3% | 4.77 |
| Tool Driven Builder (foam core)/ Carbon Fiber/Kevlar | 15.6% | 5.39 |
| Stiletto Ti-bone/ Titanium | 52.5% | 0.91 |
| Stiletto 14P/ Polycarbonate | 49.3% | 1.03 |
| Estwing 22S/ Steel | 45.1% | 1.22 |
| Estwing Big Blue/ Steel | 35.0% | 1.86 |
| DeWalt 15 Old/ Steel - I-Beam | 50.8% | 0.97 |
| DeWalt 15 New/ Steel Stamped | 52.6% | 0.90 |
| DeWalt 17 S/ Hickory Straight | 42.0% | 1.38 |
| DeWalt 17 C/ Hickory - Curved | 26.1% | 2.84 |
| DeWalt 20/ Steel | 49.9% | 1.01 |
| Powerstrike Curved/ Aluminum | 42.9% | 1.33 |
| Powerstrike Straight W/ Aluminum + Wrap | 41.3% | 1.42 |
| Powerstrike Straight/ Aluminum | 43.6% | 1.29 |
| Vaughan 23/ Hickory | 29.7% | 2.36 |
| Husky 21/ Hickory | 37.4% | 1.68 |
| Vaughan 21/ Fiberglass | 34.6% | 1.89 |
| Hart 21/ Fiberglass | 35.4% | 1.83 |

Additionally, it is another aspect of the present invention to have a head weight to handle weight ratio above 3:1. As evident from Table II above, prior art hammers have a head to handle weight ratio that is less than 3:1, with most prior art hammers having a ratio between 1 and 2. Conversely, embodiments of the present invention have a head to handle weight ratio that is greater than 4:1. Accordingly, it is another aspect of the present invention to have a ratio of head weight to handle weight that is above 4:1 while maintaining the preferred length between 35 and 47 centimeters and a total weight between 600 and 1200 grams as plotted in FIGS. 15A and 15B, respectively.

Another aspect of the present invention is an apparent handle weight less than 10% of the total hammer weight when the hammer is measured in the fully assembled configuration. The apparent weight of the head and handle of the hammer has a significant effect on the performance and comfort of the tool for the worker. The apparent weight is measured by placing the head of the hammer on a first scale and the base of the handle on a second scale. The head is positioned on one scale such that the head rests on the edge of the striking face proximate to the handle and the base of the handle rests on the second scale that is separated from the head scale by the length of the hammer. Accordingly, the weight reading shown on the scale under the head is the apparent head weight and the weight reading shown on the scale under the handle is the apparent handle weight. In some embodiments, the apparent handle weight can actually be 0% of the total weight such as when the hammer CG is so far towards the opposite end of the base that it is not only located within the head, it is located within the lateral projection of the striking face (i.e. within the diameter extending perpendicular to the striking face sitting on one scale—along the axis of the head) so that the hammer can actually balance on the striking face. Hammers with lighter apparent handle weights have less impact shock and the weight distribution of the present invention results in apparent weights of head and handle that are significantly different than any hammer in the prior art, as described in Table III below.

TABLE III

| Hammer Measurements (Two Scale Methodology) | | | | | |
|---|---|---|---|---|---|
| Hammer Brand/ Handle Material | Apparent Total Weight (g) | Apparent Head Scale (g) | Apparent Handle Scale (g) | Hammer Length (cm) | Apparent Handle Weight % of Total Weight |
| Tool Driven Framer (foam core)/Carbon Fiber/Kevlar | 641 | 613 | 28 | 43.50 | 4.4% |
| Tool Driven Builder (foam core)/Carbon Fiber/Kevlar | 735 | 700 | 35 | 44.45 | 4.8% |
| Stiletto Ti-bone/ Titanium | 893 | 624 | 269 | 43.66 | 30.1% |
| Stiletto 14P/ Polycarbonate | 783 | 571 | 212 | 40.64 | 27.1% |
| Estwing 22S/ Steel | 946 | 721 | 225 | 40.32 | 23.8% |
| Estwing Big Blue/ Steel | 1086 | 860 | 226 | 45.40 | 20.8% |
| DeWalt 15 Old/ Steel - I-Beam | 861 | 623 | 238 | 41.91 | 27.6% |
| DeWalt 15 New/ Steel Stamped | 837 | 592 | 245 | 41.91 | 29.3% |
| DeWalt 17 S/ Hickory Straight | 830 | 690 | 140 | 45.09 | 16.9% |
| DeWalt 17 C/ Hickory - Curved | 843 | 723 | 120 | 42.86 | 14.2% |
| DeWalt 20/ Steel | 797 | 574 | 223 | 35.24 | 28.0% |
| Powerstrike Curved/ Aluminum | 795 | 678 | 117 | 43.97 | 14.7% |
| Powerstrike Straight W/Aluminum + Wrap | 772 | 643 | 129 | 45.09 | 16.7% |
| Powerstrike Straight/ Aluminum | 804 | 686 | 118 | 45.09 | 14.7% |
| Vaughan 23/ Hickory | 927 | 794 | 133 | 44.45 | 14.3% |
| Husky 21/ Hickory | 949 | 783 | 166 | 45.72 | 17.5% |
| Vaughan 21/ Fiberglass | 929 | 745 | 184 | 40.64 | 19.8% |
| Hart 21/ Fiberglass | 1099 | 862 | 237 | 45.72 | 21.6% |

Figure 16A:
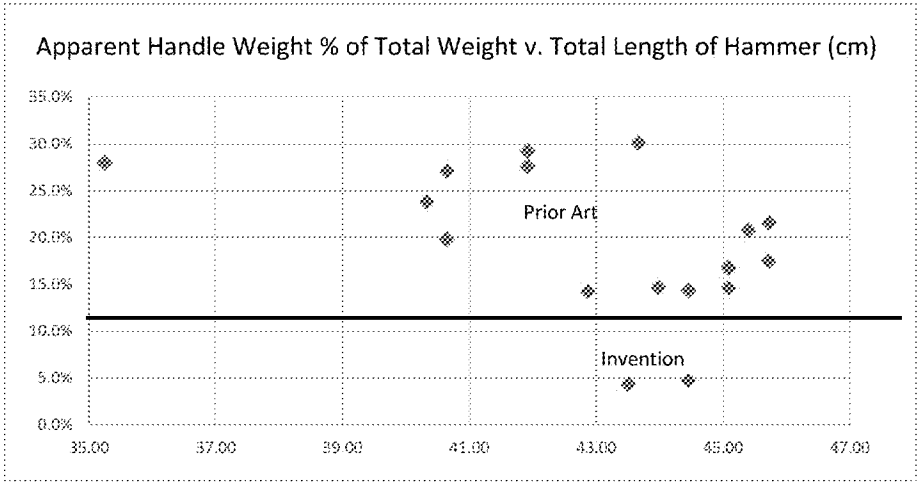
FIGS. 16A and 16B are graphs plotting the apparent handle weight relative to the total hammer weight and comparing the inventive hammer with prior art hammers.
Figure 16B:
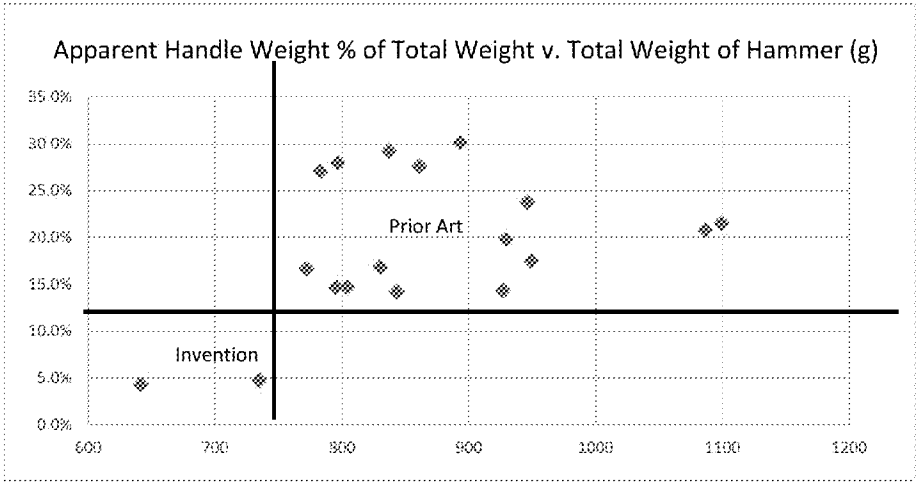

Additionally, the apparent head weight and handle weight further illustrate how the weight of the present invention is targeted towards the head of the hammer. As shown in FIG. 16 and Table III above, the apparent handle weight makes up less than 5% of the apparent weight of the hammer. Conversely, the apparent handle weight of prior art hammers are above 14%. The apparent handle weights are plotted against relative to the total hammer length and the total hammer weight in FIGS. 16A and 16B, respectively.

Figure 3B:
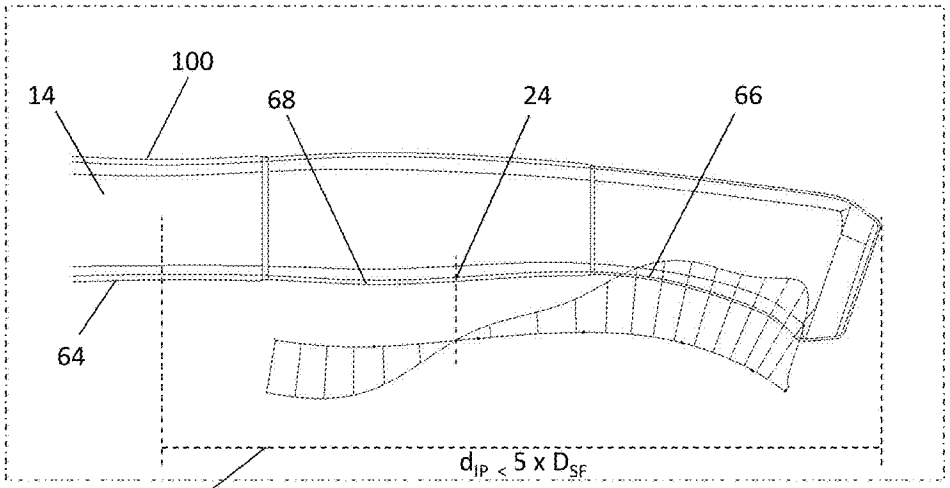
FIG. 3B is a detail view of the hammer handle shown in FIG. 3A with a schematic overlay view of a change in curvature chart for the handle shape.

Another aspect of the handle of the present invention is the proximity of the inflection point 24 to the handle's base 56 on the handle's front side 64 that faces the striking surface 16. The inflection point 24 is situated between a concave shape 66 closest to the base and a convex shape 68 as shown in FIG. 3 and generally described above. The concave shape 66 extends a distance 70 from the handle's base 56 to the inflection point at its end which is also the beginning of the convex shape 68. Accordingly, as indicated above, the distance 70 of the inflection point from the base is less than five (5) diameters of the striking face ($d_{IP}<5\times D_{SF}$) and is preferably less than four (4) diameters. As shown in FIG. 3B, a curve chart shows the degree of curvature with the concave shape closest to the base and the inflection point at the intersection between the concave shape and the convex shape.

Figures 4A, 4B, 4C:
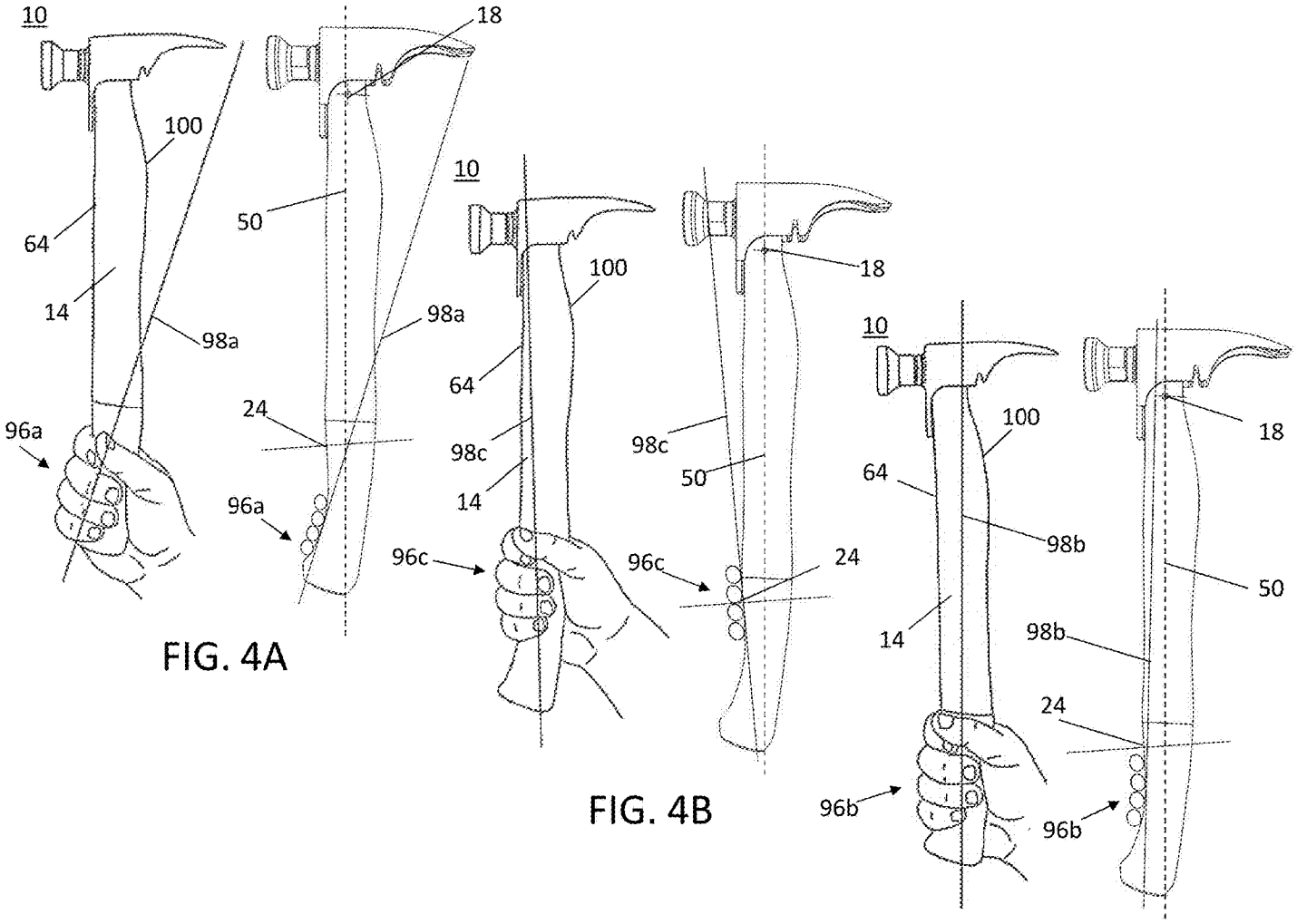
FIG. 4A shows the power gripping section of the inventive hammer.
FIG. 4B shows the precision gripping section of the inventive hammer.
FIG. 4C shows the straight gripping section of the inventive hammer.

The variations in the concave shape 66 and convex shape 68 relative to the curvature on the handle's backside 100 result in different gripping axes 98 relative to the overall longitudinal axis 50 of the handle. Accordingly, the variations in the gripping axes 98 in different sections of the handle provide for different gripping positions 96 in these handle sections. As shown FIG. 4A, the concave outer surface 66 defines a power gripping section 96*a* where the angle of the gripping axis 98*a* is substantially behind the handle's longitudinal axis 50. This axis is more useful for framing work in which excess power to drive a nail is desired and allows the user's wrist to be in a more neutral position at impact during typical framing positions as compared with the straight gripping section 96*b* and the precision gripping section 96*c*. In the preferred embodiment, the angle of this power gripping axis 98*a* is 10°-20° behind the longitudinal axis 50 of the handle. As shown in FIG. 4A, the power gripping axis 98*a* is rotated away from the striking face 16 and toward the claw 86.

As shown in FIG. 4B, the precision gripping section 96*c* corresponds with the user gripping the handle around the inflection point 24, i.e. the grip is over a portion of the convex shape and a portion of the concave shape. When a user grips the handle in the precision section 96*c*, the precision gripping axis 98*c* is rotated forward towards the striking face 16 relative to the longitudinal axis 50 of the handle. The precision section 96*c* is preferably used for finishing work and provides a gripping angle 98*c* that is 5°-10° in front of the handle's longitudinal axis. As shown in FIG. 4C, the straight gripping section 96*b* corresponds with the user gripping the handle between the precision gripping section 96*c* and the power gripping section 96*a*, i.e, within the concave shape, where the straight gripping axis 98*b* is parallel to the longitudinal axis 50 of the handle. A user gripping the handle in the straight section 96*b* has a neutral gripping angle 98*b* substantially parallel to the longitudinal axis 50 of the handle.

Accordingly, the inflection point 24 provides three separate and unique gripping sections 96 that allow a user to complete multiple jobs, including framing work and finishing work, without necessarily switching hammers. Additionally, the inflection point allows a user to effectively and ergonomically use the hammer 10 in multiple positions without sacrificing leverage since all three gripping sections 96 are proximate to the base of the handle 56. Yet, the relatively straight overall profile of the entire handle 14 does not interfere with the work surface compared to the axe handles seen in the prior art. When gripped with the middle two fingers at the inflection point, the natural gripping axis is rotated towards the striking face relative to the longitudinal axis of the handle which can be seen in FIG. 4B. Additionally, when gripped with the middle two fingers where the line tangent to the concave outer surface is parallel to the concave outer surface, the natural gripping axis is parallel to the longitudinal axis of the handle which can be seen in FIG. 4C. Additionally, when gripped with the two middle fingers where the line tangent to the concave outer surface intersects the claw portion of the head, the natural gripping axis is rotated away from the striking face or toward the claw which can be seen in FIG. 4A.

Figure 5A:
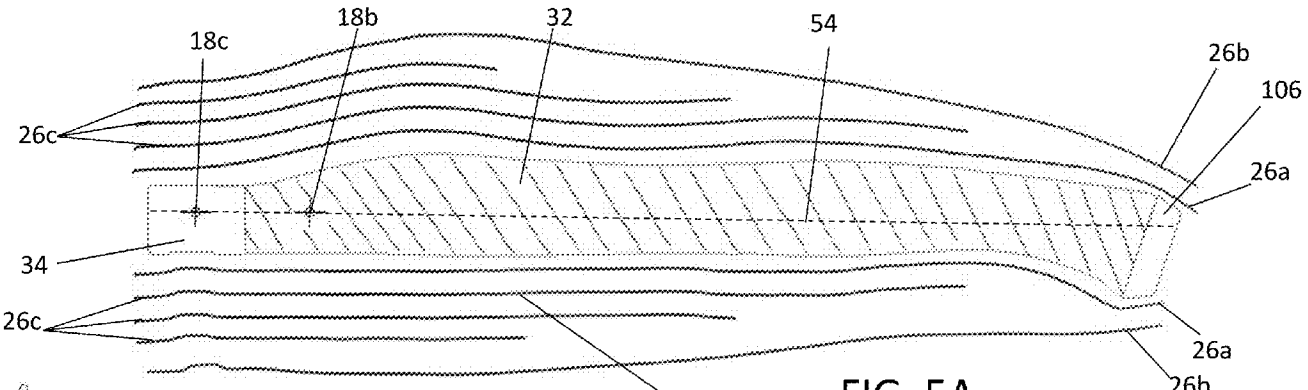
FIG. 5A is an exploded schematic view of the layers forming the handle.

Another aspect of the handle are the multiple composite layers that collectively form the handle 14 as shown in FIG. 5A. The handle is formed by laying carbon fiber and Kevlar layers over a lightweight, non-structural internal core 32 that serves only as a guide to shape the carbon sleeves as the epoxy polymer cures. The composite layers are formed around the internal core 32 that in the preferred embodiment is made of foam 32*a*. An internal layer 26*a* of composite, preferably carbon fiber, is fit around the internal core 32. Subsequently, one or more intermediate composite layers 26*c* are formed around the inner layer 26*a* and are then covered by the external layer 26*b* which is made from Kevlar in the preferred embodiment.

The carbon fiber layers of the handle 14 provide increased stiffness which increases the handle's natural frequency of vibration. Some conventional hammer handles are more flexible and have low vibration frequencies that can cause tendon problems. In comparison, the higher vibration frequencies of the stiffer carbon fiber handle, without any titanium spar or other plate along the length of the handle, are much more effectively absorbed by the skin and flesh of the worker's hand. Another benefit of the handle's increased stiffness is that the user perceives the hammer as more effective and accurate, which increases the user's confidence in the tool. Additionally, because impacts with the present invention have so little shock on the user's hand, the user is naturally encouraged to swing the tool harder. Conversely, conventional hammers with conventional weight distribution discourage forceful swings as the user subconsciously protects their hand from extreme shock. Additionally, carbon fiber handles do not have the failure modes associated with fatigue as found in wood, aluminum, titanium, and steel handles. For example, hammers with steel handles are subject to "pinging" caused by stress fractures within the structure of the handle.

Figure 5B:
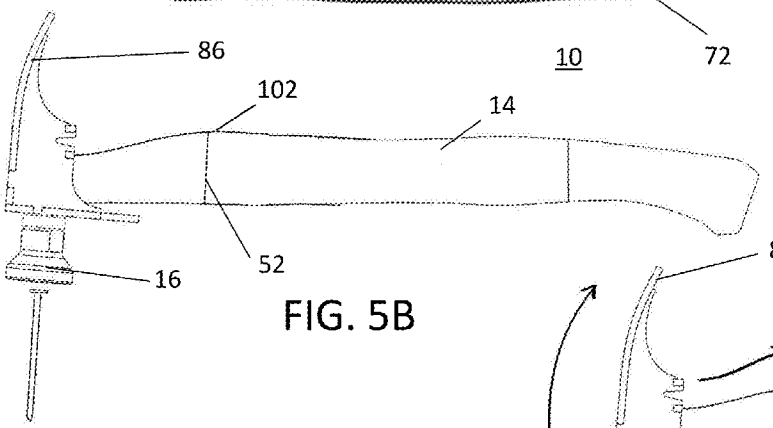
FIGS. 5B and 5C are illustrative views of the force applied to the inventive hammer at impact.
Figure 5C:
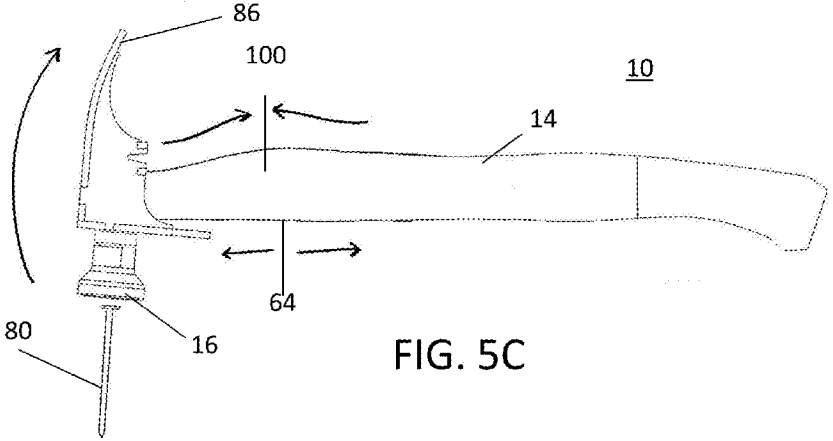
Figure 6C:
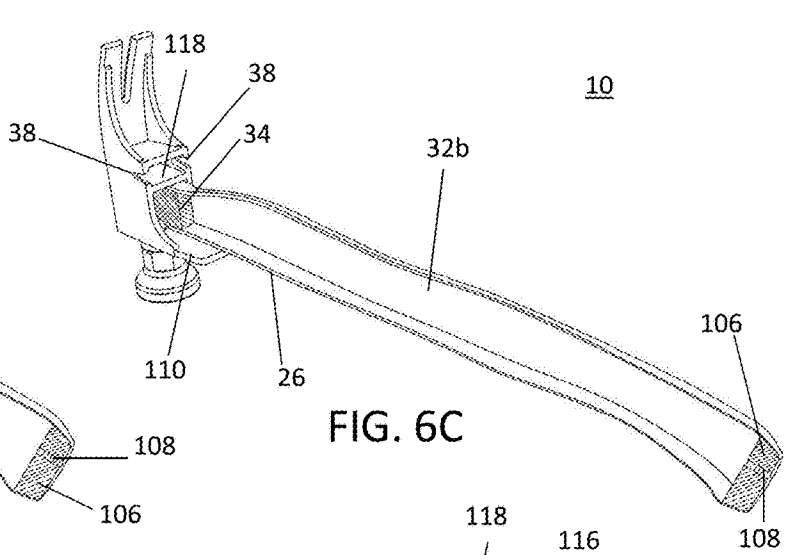
FIGS. 6C and 6D are cross-sectional views of the inventive hammer with the lightweight handle having the reinforcing block and a hollow core.
Figure 6A:
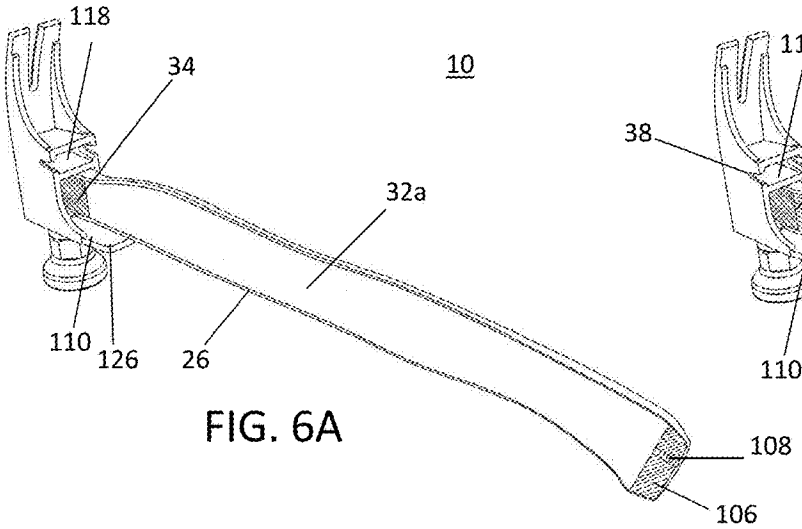
FIGS. 6A and 6B are cross-sectional views of the inventive hammer with the lightweight handle having a reinforcing block and a foam core.
Figure 6D:
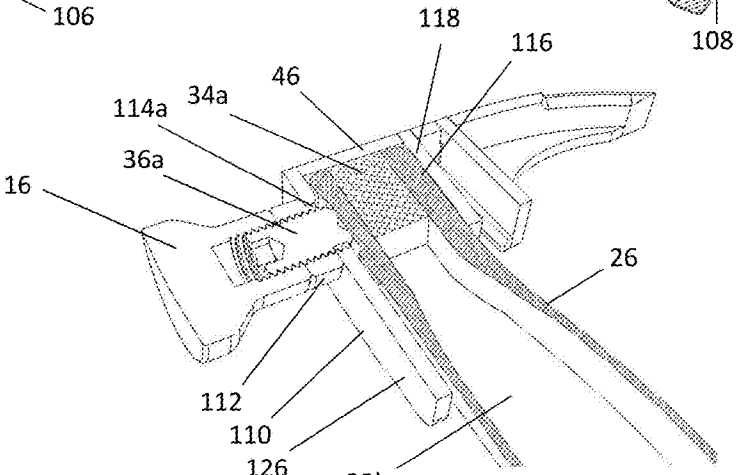
Figure 6B:
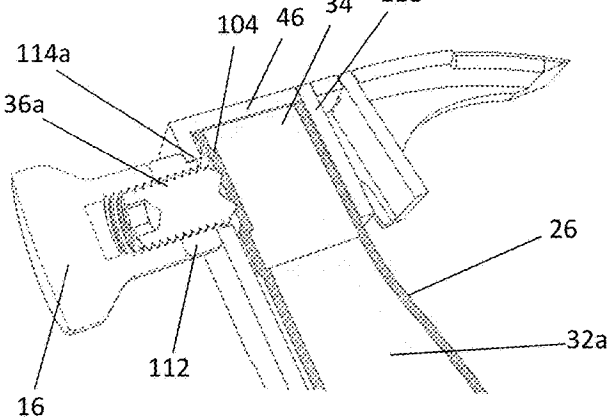

At impact, as depicted in FIGS. 5B, 5C and 12, a hammer handle 14 is under tremendous stress and the force of impact tends to rotate the head relative to the handle such that the claw 86 points toward the handle and the striking face 16 points away from the handle as illustrated in FIG. 5C. During this rotation, the backside 100 of the handle is under compression and the front side 64 of the handle is under tension. Accordingly, the handle shape near the head is designed so that the distance between the tension section and compression section is as large as reasonably possible in order to strengthen this inherently weak area of the hammer. Additionally, a hump 102 as depicted in FIG. 5B on the backside 100 of the handle 14 of the present invention allows the shell of the handle to flex slightly, acting as a spring to absorb the rotational motion of the head at impact. In effect, the hump 102 keeps the striking face 16 in contact with the nail 80 slightly longer and thereby facilitates more energy transfer to the nail. The humped spring 102 also reduces the likelihood of stress fractures in the composite handle 14. Additionally, the stresses in the handle are not uniform from the mounting end 74 of the handle to the base 56 of the handle. The stresses are largest near the head 12 and get progressively smaller towards the base. Accordingly, as shown in FIG. 5A multiple intermediate layers 26*c* are used in varying lengths in order to keep the handle as light as possible, but stiff during use. As described herein, the internal layer 26*a* and external layer 26*b* are the full length of the hammer handle 20 and the intermediate layers 26*c* are shorter in order to provide greater composite material thickness where the stress is highest.

The intermediate composite layers 26*c* of carbon fiber are positioned around the inner layer 26*a* proximate to head 12 of the hammer which then extends a length 72 towards the base 56. However, the length 72 of the intermediate layer 26*c* is shorter than the handle length 54. Accordingly, it is an aspect of the intermediate layers 26*c* to only extend across parts of the handle 14 that experience high stress when the hammer is swung and impacted. For example and as discussed in the hump design 102 above, the backside 100 of the handle directly below the head may have multiple layers of composite material as this is a point of high stress, as shown in FIG. 5A.

It is another aspect of the handle of the present invention to have an external layer 26*b* that covers the inner layer 26*a* and extends the entire length of the handle 54. Accordingly, the intermediate layers 26*c* are sandwiched between the inner layer 26*a* and external layer 26*b* as depicted in FIG. 5A. In the preferred embodiment, the external layer is made of Kevlar but other types of lightweight, high strength materials may be used. Accordingly, the multiple composite layers collectively form the handle 14 of the present invention. The Kevlar® composite layer is preferred as the outer layer because Kevlar fails by becoming stringy and fuzzy rather than splintering which is the failure mode of most other composite layers that may be used, such as fiberglass and carbon fibers. When carbon fiber fails, it fails catastrophically and can separate into multiple pieces with jagged edges so the failure mode of Kevlar as the outer layer is preferred. Using this as an external layer 26*b* prevents splinters and lacerations during a handle failure and keeps the head attached to the handle, even under catastrophic failure conditions. Additionally, the Kevlar external layer can be dyed different colors for individual choice in hammer color. A surface coating may be applied to the handle, such as a clear coat or possibly even which may help protect the outer composite layer because as the surface layer of reinforcing epoxy wears through normal use, the actual composite fibers will be exposed which can splinter and cause irritation to the user's hand. Additionally, the gripping section preferably includes a low durometer rubber layer or a shrinkable rubber section to provide a tacky, satisfying grip.

In another aspect of the preferred embodiment of the present invention, the internal core 32 is made up of a foam core 32*a* and a reinforcing block 34 embedded within the layers of composite at the mounting end 74 of the handle 14. Examples of the internal core 32 and reinforcing block 34 can be seen in FIG. 6. This reinforcing block 34 serves to prevent the high compression forces of the set screw 36*a* from crushing the carbon fiber handle, as described below. Additionally, by adjusting the material and shape of the reinforcing block 34, it can be used to alter the overall weight of the hammer. Although the reinforcing block 34 is metal in the preferred embodiment, a reinforcing block made of a carbon fiber 34*a* structure may also be used which can be seen in FIG. 6D. Acceptable carbon fiber structures include but are not limited to honeycombed, grid and lattice structures. This lets the user choose the hammer weight that best fits both their personal preference and the application, like framing, siding, and finishing. The shape of the reinforcing block 34 can also be adapted to work as a fastener preload spring to compress the set screw to its correct specification. This preload spring function can work in conjunction with the spring force provided by deformation of the carbon fiber around the reinforcing block. Additionally, the preferred reinforcing block includes an undercut 104 on the set screw side as a safety feature to ensure that if the set screw were to loosen during use, the head would stay attached to the handle.

As described above, the composite layers are formed around the internal core 32. However, once the composite layers have been set, the internal core does not provide structural support or strength. To protect the composite shell at the base of the handle, a protective plug 106 made from resin, plastic, rubber or similar material is inserted inside the shell connected to the core 32 and is held in place by the composite layers once they have cured. Additionally, the plug has a vent hole 108 for expanding foam. In the preferred embodiment the foam core 32*a* extends from the plug 106 at the base 56 of the handle to the reinforcing block 34 held within the mounting end 74 of the handle attached to the head 12. Accordingly, the composite layers may be formed around the foam core 32*a*, reinforcing block 34, and plug 106 which together form the internal core in the preferred embodiment. In another embodiment, the foam core may not be used at all and the internal core 32 can be comprised of a protective plug 106, a hollow core 32*b* and the reinforcing block 34. Regardless of the embodiment, when the reinforcing block is used at least one of the foam core, hollow core, or other core material extends from the reinforcing block to the protective plug at the base of the handle. Accordingly, it is an aspect of the core to be lightweight and only provide shape to the composite layers as they are being laid and formed, which is described below.

In another aspect of the preferred hammer, the reinforcing block is held within the internal core 32 at a position opposite the base, which defines the mounting end 74. At least a portion of the mounting end 74*a* of the handle is inserted into the head void 94 substantially perpendicular to the end face 46*a* of the head, as shown in FIG. 6 and FIG. 7. Accordingly, the head 12 and handle 14 are connected at the mounting end 74 and the reinforcing block 34 may be used to provide a more secure connection. In the preferred embodiment a set screw 36*a* secures the handle to the head as the set screw extends through a threaded fastener 112 and a hole 114*a* in a front plate 110 of the head 12. The screw is preferably aligned with the central point of the striking face 16 and the head's longitudinal axis 42. The set screw 36*a* is then tightened until at least a portion of the set screw compresses into the composite layers surrounding the reinforcing block 34. Accordingly, the reinforcing block prevents the relatively thin layer of carbon fiber that forms the structural part of the handle from crushing under the forces applied by the set screw.

Figure 7B:
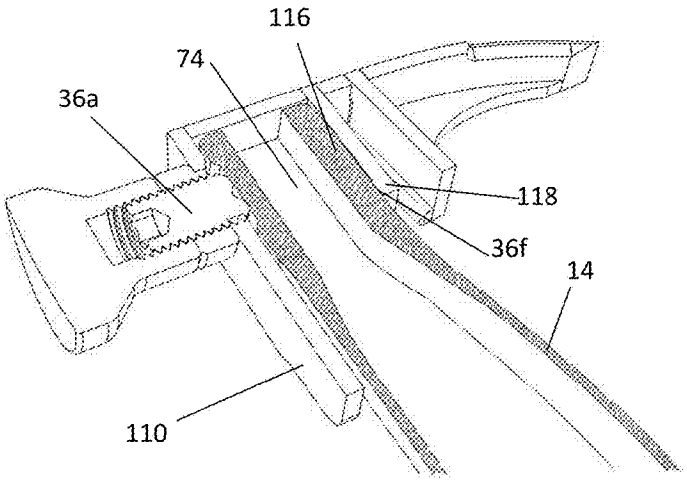
FIGS. 7A-7H show cross-sectional views of alternative heads for the hammer.
Figure 7A:
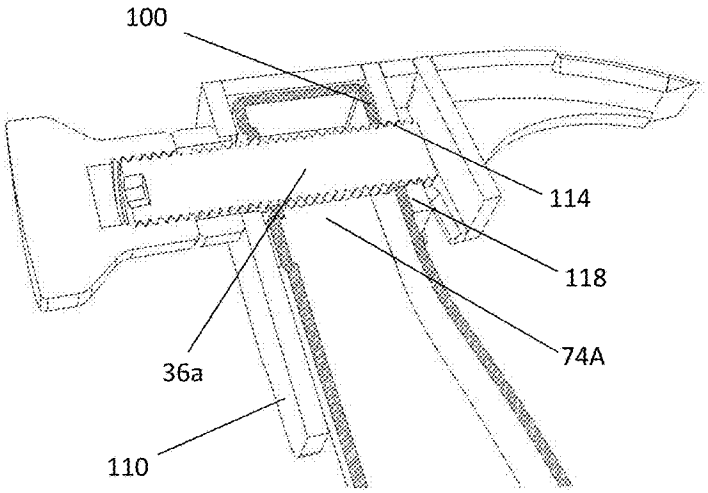

In another embodiment the handle 14 does not have the reinforcing block 34 and the set screw 36*a* extends through the front side 64 of the handles 14 mounting end 74 and compresses into the composite layers of the backside 100 or extends completely through a hole 114*b* on the back side of the handle 100, as shown in FIG. 7A. In this embodiment it is preferred that the mounting end 74 of the handle has a thicker composite layer 116, as in FIG. 7B, sufficient to resist the pressure applied by the set screw 36*a*. Like in FIG. 7A, the set screw extends completely through the handle and the screw does not impinge the handle itself but instead presses against the back plate of the head 118. Accordingly, the back plate 118 and front plate 110 pinch the handle and lock it in place. Additionally, other means for connecting the head to the handle may be used including but not limited to those described below.

In another embodiment, the handle 14 is mounted to the head 12 by securing the head within the handle with an adhesive 36*f*. As is traditionally done with polycarbonate and other plastic handles, an epoxy or glue may be used. Although inexpensive, using an adhesive 36*f* to attach the head to the handle makes the handle difficult to replace. Accordingly, the preferred adhesive is an epoxy resin that can be baked out by a user allowing the handle or head to be subsequently replaced. Additionally, an adhesive can also be used in combination with the other embodiments shown in FIGS. 6 and 7, including the preferred handle having a reinforcing block 34 in the mounting end of the handle held secured into the head void 94.

Figure 7C:
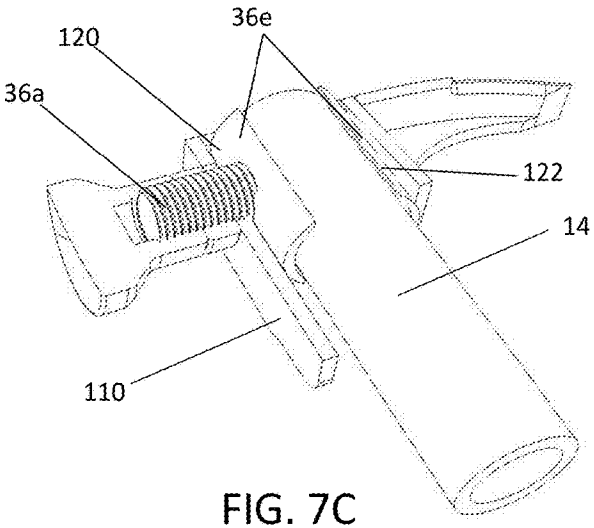

In the embodiment depicted in FIG. 7C, the handle is mounted to the head by clamp 36*e*. In this embodiment, the set screw 36*a* is also used and freely rotates within the clamp attachment 36*e* and the front clamp 120 moves relative to the fixed rear clamp 122 which is integrated into the back plate of the head 118. Additionally, a curved clamp 36*e* offers a more secure attachment because the curved clamp applies even pressure along more surface area of the handles mounting end 74. Accordingly, the composite layers do not necessarily need to be thickened to withstand the pressure exerted by the set screw if the reinforcing block is not used, as discussed above and shown in FIG. 7B. This embodiment for the head may also be used with a handle formed from a different lightweight material, such as a tube made from aluminum or titanium.

Figure 7D:
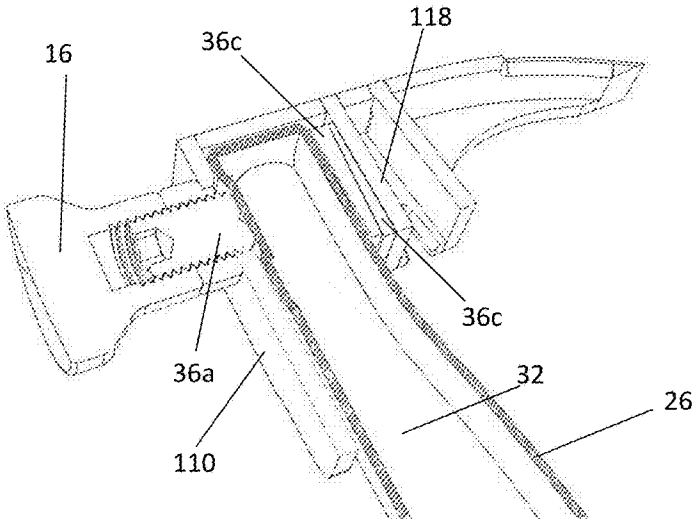

In another embodiment, the handle is mounted to the head by two opposing wedge fasteners 36*c* that lock the handle into the head void 94, which can be seen in FIG. 7D. While wedges have been used to attach hammer handles for centuries, they are usually driven into the center of a wood handle to expand a wood to grip the inside surface of an eye in the head. Following that method with a carbon fiber handle is counterproductive because it may crack the carbon fiber at the high stress head/handle joint. However, when opposing wedges are used, the wedge fasteners 36*c* compress the handle towards the striking face 16 without damaging the composite material. Additionally, the wedge fasteners 36*c* may be held in place by set screws or some other method to prevent drifting while using the hammer.

Figure 7E:
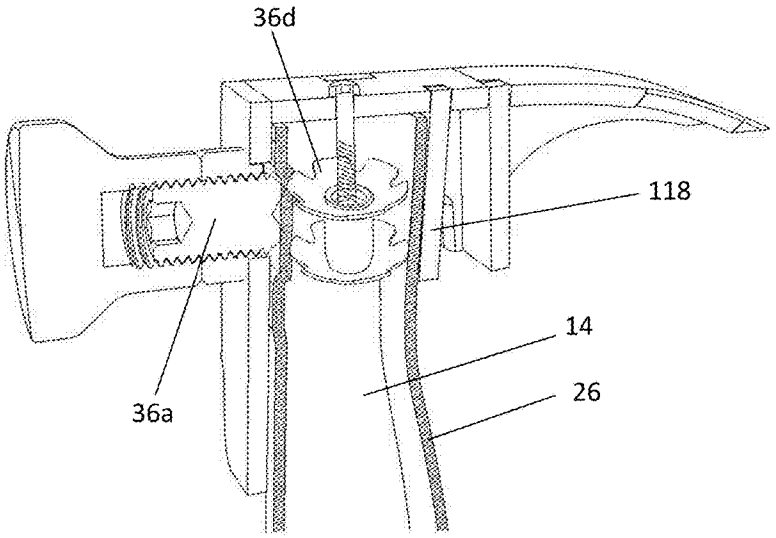

In the embodiment depicted in FIG. 7E, the handle is mounted to the head by an expanding star nut 36*d* extending through the top side of the head 46 into the mounting end 74 of the handle. Although traditionally used to attach bike forks to handle bars, the star nut 36*d* locks the head of the hammer to the handle from the top side rather than the striking face 16 side of the head. Additionally, this method requires two fasteners, the set screw 36*a* and expanding star nut 36*d*.

Figure 7H:
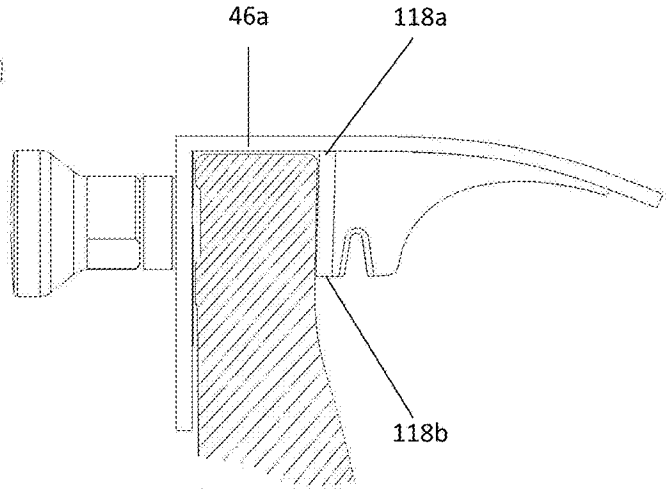
Figure 7F:
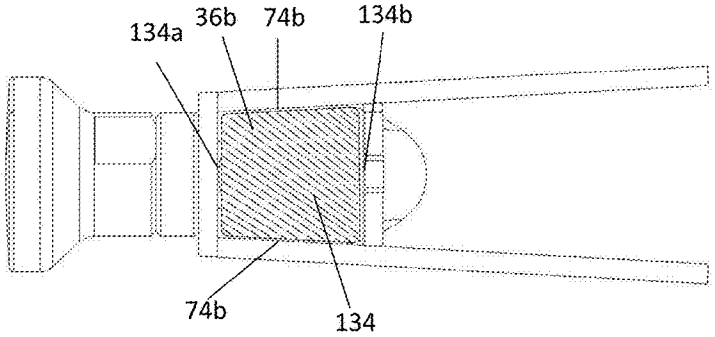
Figure 7G:
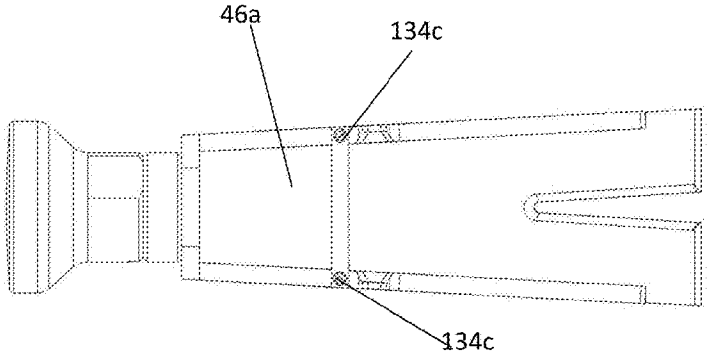

In another embodiment, the handle is attached to the head using a wedging system, shown in FIGS. 7F, 7G and 7H. In this embodiment the side wall of the mounting end 74*b* are canted outward and secured in a wedge shaped head void 134, with the front side of the wedge shaped head void 134*a* narrower than the backside of the wedge void 134*b*. The handle is inserted into the wedge shaped head void and then locked in place with the back plate 118. The back plate is secured with screws 134*c* to prevent the back plate from dislodging. Those having skill in the art will appreciate that repeated impacts will serve to drive the wedge shaped mounting end further into the wedge shaped head void, thereby tightening the handle to head joint with use. The end plate may be curved slightly to provide spring force to push the wedge shaped mounting end of the handle into the wedged shaped head void. Additionally, the back plate is installed with a slight taper such that the top of the back plate 118*a* proximate to the end plate is further from the striking face than the opposite end of the back plate 118*b* that is closer to the striking face. Accordingly, the handle cannot be withdrawn from the head under prying impacts or from general use before repeated impacts have driven the handle to solid contact with the wedged sides of the handle head void.

In addition to the light weight handle in the preferred embodiment the hammer 10 has a number of new usability features while maximizing strength and durability. The striking face 16 is field replaceable simply by screwing a new striking face onto the head 12. This way, the same hammer can be used for both framing and finish applications. In the preferred embodiment, the striking face 16 is secured to the head by the end of the set screw 36*a* opposite that attaching the head and handle. The front plate 110 of the head consists of the hole 110 through which the set screw passes 36*a*, shown in FIGS. 6B, 6D, 7A, 7B and 7D. In the preferred embodiment the hole 110 is centered on the front plate, eighteen millimeters in diameter and the set screw is an M16×2, however it will be appreciated by those having skill in the art that set screws of varying sizes could also be used and the size hole 110 in the of the front plate will vary accordingly. Thus, the single set screw goes through the front plate 110 and the head void 94 and pins the handle 14 to the back plate 118 while protruding far enough towards the striking face 16 to serve as an attachment stud 124 for the modular striking face 16 which can be seen in FIGS. 6B, 6D and 7.

Additionally, the front plate 110 consists of an overstrike portion 126 extending below the head 12 along the front side of the handle 64. The overstrike portion 126 is no greater than one striking face diameter 60 away from the longitudinal axis of the head 42. Additionally, the overstrike portion 126 is wide enough to protect the composite handle from damage resulting from miss hits. In the preferred embodiment, the overstrike portion 126 is an extension of the front plate 110 towards the base of the handle 56. However, in another embodiment the overstrike portion may be a protective metal plate embedded under the external layer of composite material on the handle. Regardless of the embodiment, the overstrike portion is designed to protect the composite handle proximate to the head of the hammer.

An aspect of the striking face shown in FIG. 10 is a malleable striking surface 88 having embedded grit materials 90*a*. The malleable striking surface 88 is an improvement over conventional steel striking faces but is similarly mounted to the head of the hammer. The striking surface area 88*a* of the steel striking face contains a shallow indentation 88*b* having tapered walls 88*c* depicted in FIGS. 10A and 10C. A wad 90 made from a deformable material, typically silicon bronze, aluminum bronze, lead or another similar alloy, is placed within the striking face indentation 88*b* and extends beyond and over the top of the tapered outer walls 88*c* as shown in FIGS. 10B and 10D. The wad 90 is held within the indentation 88*b* by the tapered walls 88*c* that create an interlocking fit. Additionally, the wad is welded into the indentation causing the wad to bond with the steel substrate of the striking face. The grit 90*a* embedded into the wad 90 are small, hard particles and are preferably aluminum oxide or silicon carbide, but similar materials may also be used. The particles are roughly 0.25 to 0.75 millimeters in diameter and are homogeneously distributed throughout the material. In effect, the alloy striking surface has a textured and scratchy outer face.

In operation, when the malleable striking surface 88*a* hits a fastener, like the head of a nail 80, with sufficient force the striking face will deform around the struck surface and thereby prevent the striking face from sliding off. Additionally, the repeated nail impacts on the deformable material knead the surface of the striking face 88*a*, burying some of the grit 90*a* particles and exposing others. After multiple strikes, the malleable material may mushroom over the edges of the steel striking face 88*a*, but hammering the mushroomed material on the side of the striking face will fold the deformable material back onto the striking surface 88*a*. Additionally, as a user is unlikely to strike a nail at the same position on the striking face each swing, the malleable striking surface 88*a* remains reasonably flat causing neither miss-hits nor flush setting blows to leave unsightly imprints on the surface the user is striking. Additionally, if the hammer is not swung with enough force to deform the malleable material, the embedded grit 90*a* provides a textured surface to prevent slipping. In addition to lighter blows, the malleable surface may deform if the hammer is swung at an angle and the striking face does not have a flush impact with the nail head or other surface being struck.

In another embodiment, shown in FIG. 11, the striking face may have a carbon spool spring striking face 128 that increases striking efficiency and provides improved user feedback. The carbon spool spring provides a progressive spring effect by using a cylinder of composite fiber as the deformable body, rather than having the deformation occur on the impact surface. The carbon spool spring is made up of the striking face 128*a* which can be smooth, textured, or micro textured, and a threaded mating component 128*b* attaching the striking face to the set screw 36*a* on the hammer head 12. The striking face 128*a* and threaded mating component 128*b* are connected using an epoxy glue to form a thin, stiff neck 128*c*. Both the striking face and mating component are roughed up to provide a positive physical interaction with the epoxy connecting the two. Additionally, composite fiber tape is wrapped around the neck which ultimately provides the spring action once the entire assembly 128 is mounted onto the head of the hammer. In operation, the epoxy neck 128*c* is pulverized after the first few impacts and the carbon wrap 128*d* provides the spring. This spring effect is particularly effective during off-center strikes as the forward, impacting portion of the striking face pivots toward the off-center strike rather than throw the entire head assembly off to one side at impact. With a conventional, solid striking face, an off-center strike tends to bend the nail toward the center of the striking face as the striking face drags laterally across the head of the nail. Conversely, with the carbon spool spring striking face 128, the pivoting action prevents the lateral drag across the nail and prevents bending nails on off-center strikes.

Another aspect of the head of the present invention is a double nail-pull 38 made up of a pair of notches 76*a*,76*b* on opposite sidewalls 78*a*,78*b* of the head, slightly off-center from the side of the handle which can be seen in FIG. 9. The first notch 76*a* engages the head of the nail 80*a* and a user may rotate a portion of the nail 80 of out the wall, board or similar surface to first position 82 as shown in FIGS. 9A and 9B. Subsequently, the head of the hammer can be repositioned into a second position 84 where the second notch 76*b* engages the head of the nail 80*a* and the first notch 76*a* engages a shank of the nail 80*b* as shown in FIG. 9C. Accordingly, the hammer can again be rotated about the nail-pull and the nail can be completely pulled out of the wall, board or similar surface as shown in FIG. 9D. Accordingly, the double nail-pull 38 increases the mechanical advantage where a user can engage the nail in more than one position. The double nail-pull mechanical advantage is nearly 400% higher than a conventional nail pulling claw. Additionally, since it is possible for a nail to reach directly from the notch on one side wall all the way to the notch on the other side wall, even the longest nails can be pulled almost completely free of the wood using very high mechanical advantage. Additionally, since the side nail pulls are offset from the side of the handle, the user can pull nails with a very high mechanical advantage by pulling the handle sideways and towards the claw, but may also pull nails with a lower mechanical advantage and a larger range of motion by pulling the handle sideways and towards the striking face. Additionally, the notches have a small chamfer routed along the inside of the opening to provide a more effective profile for the nail pulling feature.

Figure 8A:
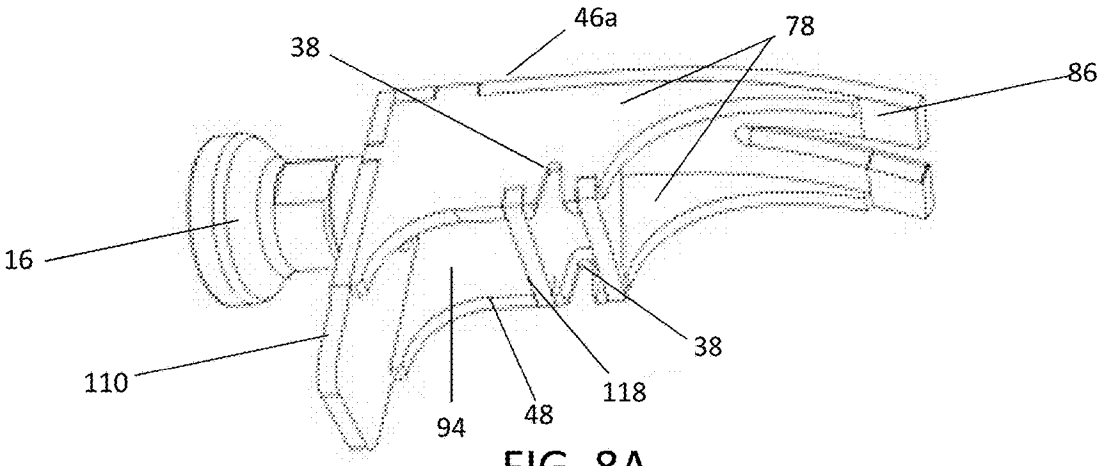
FIG. 8A is a perspective view of the head of the inventive hammer.
Figure 8C:
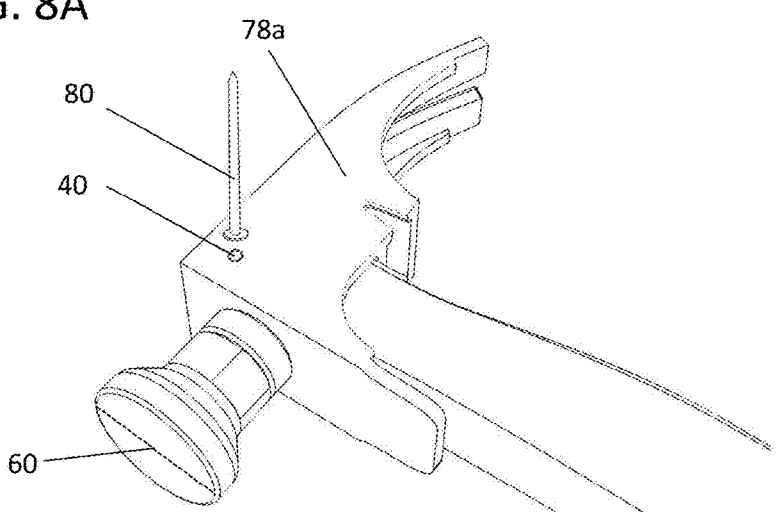
FIGS. 8B and 8C are perspective views of the head with a magnet insert.
Figure 8B:
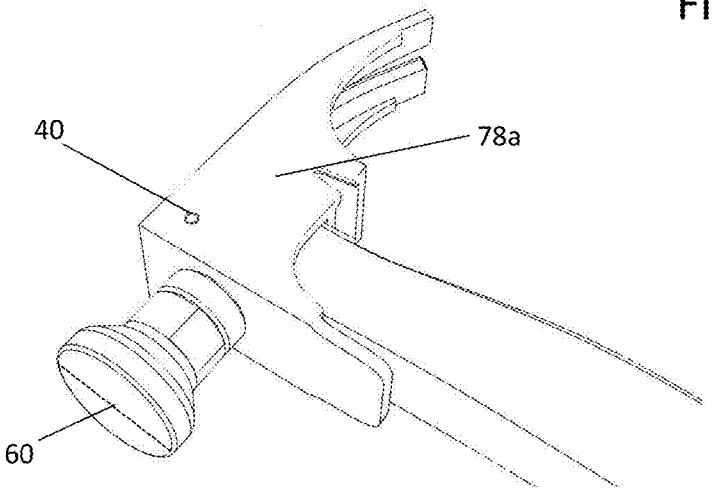
Figure 9B:
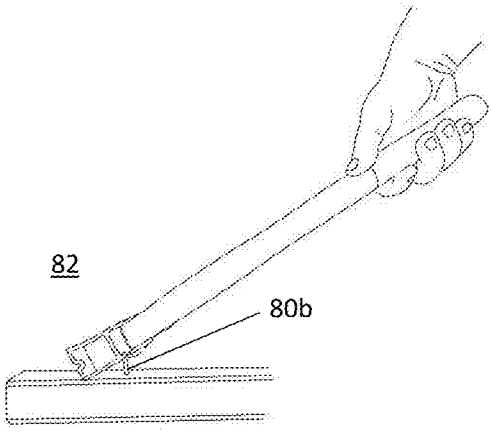
FIG. 9A-9D are perspective views of the double-nail pull of a hammer with lightweight handle.
Figure 9D:
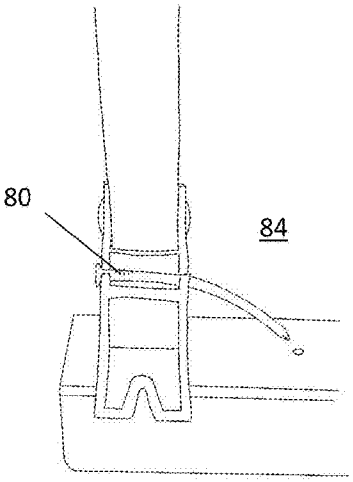
Figure 9A:
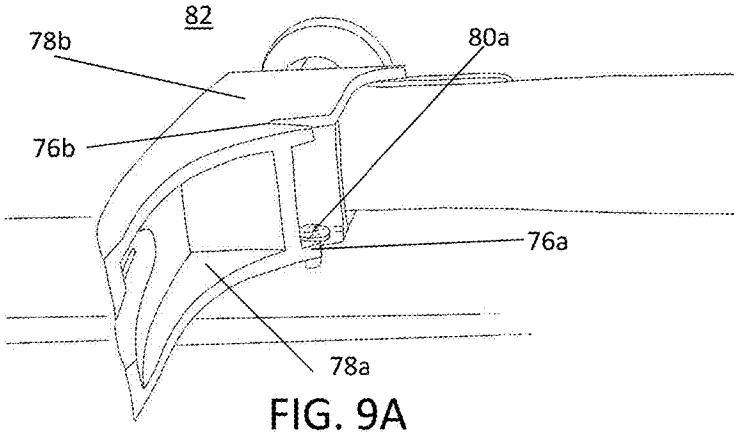
Figure 9C:
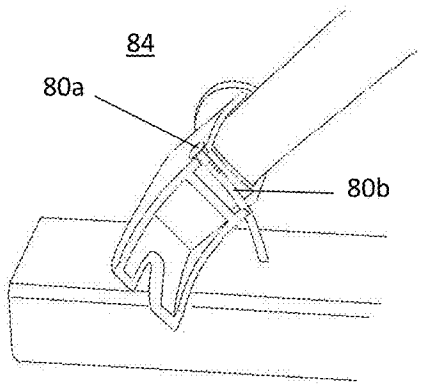
Figure 10B:
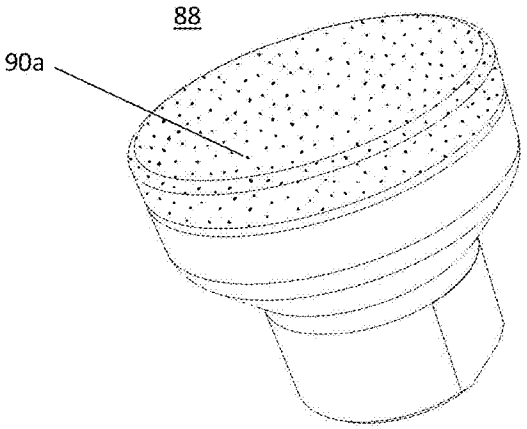
FIGS. 10A and 10B are perspective views of a malleable striking face.
Figure 10D:
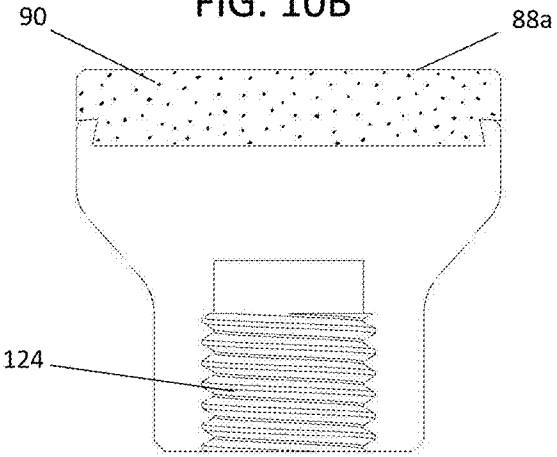
FIGS. 10C and 10D are cross-sectional views of the malleable striking face.
Figure 10A:
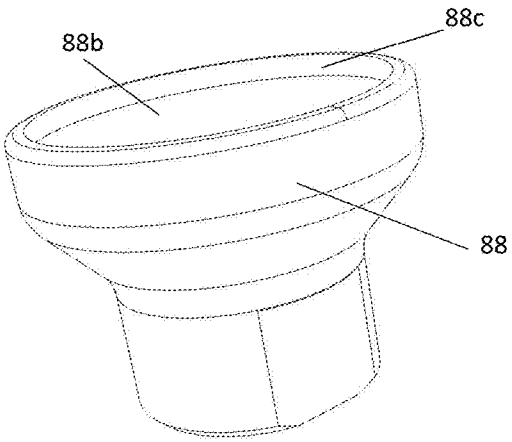
Figure 10C:
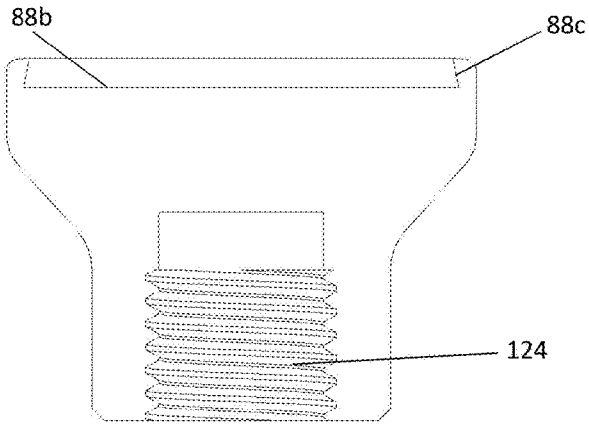
Figure 11A:
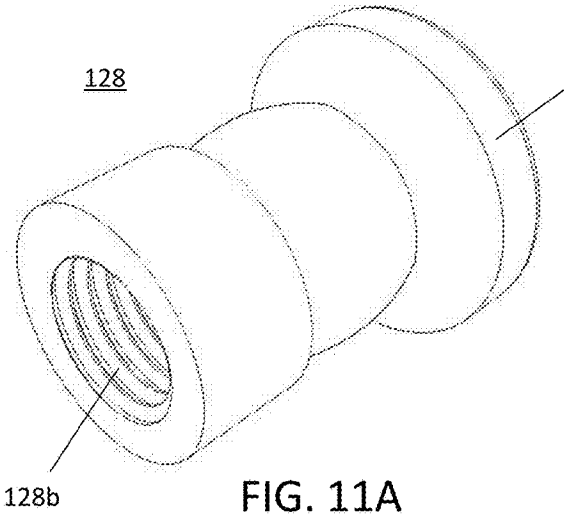
FIG. 11A is a perspective view of a spring striking face.
Figure 11B:
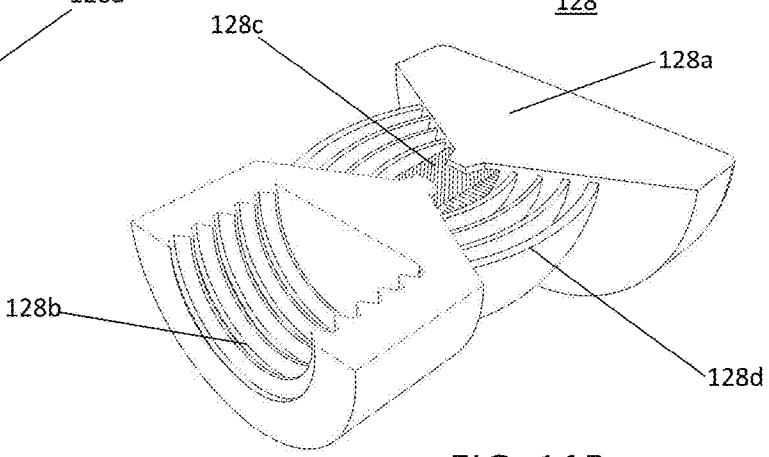
FIG. 11B-11D are cross-sectional views of the spring striking face.
Figure 11C:
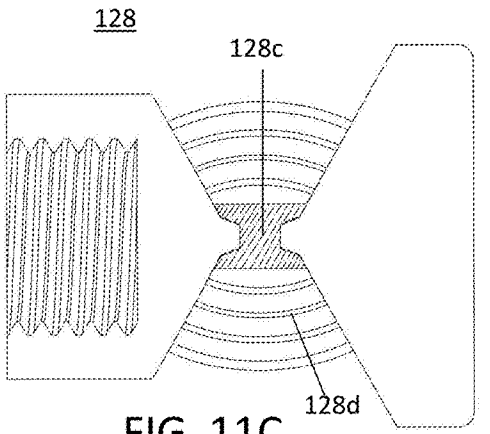
Figure 11D:
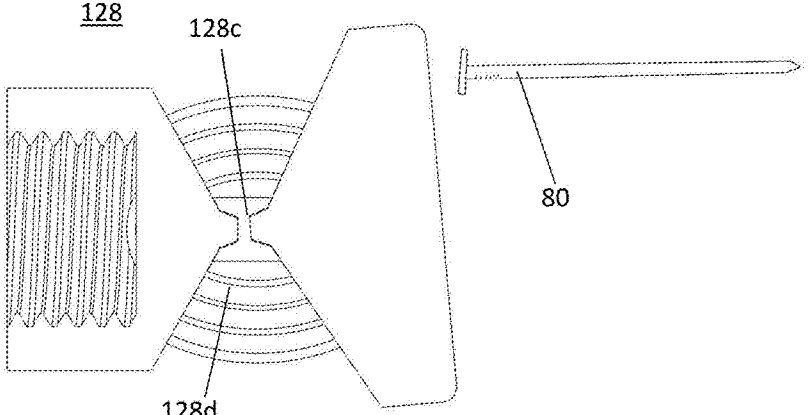

Another aspect of the head of the present invention is a magnet insert 40 affixed within at least one of the side walls 78 of the head, as shown in FIGS. 8B and 8C. This magnet insert 40 is made up of a high-strength rare-earth magnet embedded into least one of the side walls of the head. This magnet allows the user to start nails by placing a nail head against the magnet and swinging the hammer sideways. Unlike conventional nail starters on typical hammers of the prior art, the present invention places the nail starter on the side of the head. Accordingly, by aligning the nail starter perpendicular to the shortest axis of the head, nails can be started in much tighter environments when compared to the nail starters on other hammers available today. Additionally, the magnet insert is sized so that the nail head overlaps the magnet and sits on the harder steel surface surrounding the magnet.

During the preferred method of manufacturing of the handle, the reinforcing block 34 is machined to the desired dimensions. Though the design can vary, all reinforcing blocks have dimensions matching the mounting end of the handle and receiving feature on the head. Additionally, the reinforcing block is machined to compensate precisely for the thickness of the composite fiber layers. The blocks are machined at 90 degrees to ensure that the finished head is properly aligned with the handle. Also, the undercut section 104 is machined for set screw contact. Next, a foam handle blank is cast and the reinforcing block 34 and protective plug 106 are placed at opposite end of a female mold made from a master handle. A two-part expanding foam is poured into the mold and allowed to expand until the foam expands to the proper shape and bonds to the reinforcing block and protective plug.

Once the foam has expanded and bonded to the reinforcing block the internal core 32 is complete and removed from the mold where it is covered with the inner composite layer 26*a*, extending the entire length of the internal core. The inner composite layer is wetted with epoxy and the intermediate composite layer 26*c* is laid over the inner layer first—but this section only extends from the reinforcing block 34 to the top of the precision gripping section. As discussed above, the intermediate layer extends from the head side of the internal core towards the base. In the preferred embodiment the intermediate layer is approximately eight inches (20 cm) long. Another intermediate layer is laid which is approximately fourteen inches (36 cm) long and reaches just to the neutral section of the handle, proximate to the inflection point. Then, another intermediate layer 26*c* is laid which is approximately fifteen inches (38 cm) long. However, the number and length of the intermediate layers may be altered to change the stiffness and natural flex points of the handle. Finally, the full length external layer 26*b* of Kevlar is laid on the handle. Each new layer of composite is wetted with epoxy and the excess is wiped off.

Once all the layers have been formed, the handle 14 assembly is inserted into a specially treated heat shrink tubing. A heat gun or oven is then used to shrink the tubing to compress the layers of composite material and epoxy while the handle cures. After 24 hours, the shrink wrap is removed from the handle, and the excess carbon composite layers are cut from both ends with a diamond saw. The grip end of the handle proximate the base 56 is dipped in a low durometer rubber or a shrinkable rubber section is applied to the outside of the grip end to provide a tacky, satisfying grip.

A second embodiment of the handle manufacture is to use no internal structure at all. By using a two piece mold and an inflatable bladder, layers of composite are wrapped around the inflatable bladder. The bladder and carbon are then inserted into a hard-shell female mold. The bladder is then inflated, compressing the carbon and Kevlar layers against the outside of the mold until the polymer has cured sufficiently.

The head 12, shown in FIG. 8A, is manufactured by welding pieces of plate steel together, making it easy to manufacture with ultra-high quality steel, stainless steel, or other exotic alloys which are not usually forgeable. A welded head has an additional advantage that by altering the thickness of the plates, the final weight of the head may be altered without having to retool forging molds. Welding allows the hammer head to be manufactured for specific applications as when welded with a silicon bronze filler metal that is better for pure impact applications since silicon bronze can deform further prior to cracking. However, where prying is more important, a different filler rod can be used to make the weld more homogeneous with the other metal parts. The side plate to claw welded joint reaches nearly to the end of the claw and consequently provides two advantages. First the tip of the claw can be ground to a relatively acute angle which improves the hammer's ability to dig under nails or in between boards for prying applications. Second, since the side plate joint covers the area where the claw would actually engage a nail during a nail pull, the claw tines are extremely strong.

In the preferred embodiment, the head is made from several individual pieces of flat metal stock like high carbon steel, stainless steel or similar materials. These pieces are cut from a single sheet of metal using a plasma cutter and template, a CNC plasma cutter or water jet and a nut with a female internal thread or other threaded fastener is welded to the front flat plate 110 of the head proximate to the striking face 16. In the preferred embodiment, the internal threaded nut 112 is M16×2 mm, but it should be appreciated that other sized threads can be used. Additionally, for a front plate with sufficient thickness, the front hole 114*a* can be threaded. Then the end plate 46 is bent over a precision form to match the curve of the side walls 78. The head is then welded together using a TIG welding process and depending on application, the TIG filler rod may be silicon bronze or a metal rod that matches the chemistry of the flat plates more precisely. Lastly, the M16 female threaded screw nut 112 is welded to the front of the front plate 110 which receives the set screw when the head is attached to the handle. This piece can be a conventional nut, a round bar with a drilled hole that is threaded or any other threaded fastener. In another embodiment, the head could be manufactured by creating a male and female die set. The metal plates would be then cut out, but left attached with additional margin to accommodate the bend. This blank would then be bent by a male and female die that forms the near-final head shape.

A final grinding operation removes excess weld material from the sides and sharpens the claw. The fully assembled heads are then heat treated to ensure that the metal has the ideal physical characteristics of hardness and pliability. Finally, the heat treated heads are tumbled in a vibratory tumbler with ceramic media to give the piece a pleasing, consistent finish. The heat treated heads may also be surface ground, wire brushed or finished with an abrasive pad. Subsequently, the entire hammer is ready to be assembled and a handle is inserted into the head and the set screw is tightened onto the handle. Lastly, a striking face is then tightened onto the exposed section of the set screw.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A hammer, comprising:

a head having a first longitudinal axis, a striking face perpendicular to the first longitudinal axis, a head length extending along the longitudinal axis, and a top having an end face; and a handle connected to the head at a side of the head opposite from the end face, wherein the handle comprises an internal composite layer, an external composite layer, and at least one intermediate composite layer between the internal composite layer and the external composite layer, wherein the internal composite layer is formed around an internal core, wherein the handle has a second longitudinal axis substantially perpendicular to the first longitudinal axis, a maximum lateral dimension less than the head length, and a handle length, wherein the head and the handle comprise a total hammer length extending between a base of the handle and the end face of the head, wherein the hammer has a center of gravity proximate to the end face at a location that is 85%-95% of the total hammer length measured from the base, wherein a diameter of the striking face of the head is less than 1.5 times the maximum lateral dimension of the handle, and wherein the internal composite layer and the external composite layer extend the handle length along the second longitudinal axis, wherein the intermediate layer is proximate to the head and extends a length towards the base, and wherein the length is shorter than the handle length.

2. The hammer of claim 1, wherein a total hammer weight of the head and the handle is between 0.5 kg and 1.5 kg, and wherein a handle weight is between 10%-20% of the total hammer weight.

3. The hammer of claim 1, wherein the handle weight is between 0.075 kg and 0.15 kg, and wherein the total hammer length is between 13 inches and 20 inches.

4. The hammer of claim 1, wherein a front side of the handle is comprised of a concave outer surface proximate to the base of the handle and an inflection point at an end of the concave outer surface, wherein the inflection point is located a distance away from the base of the handle, and wherein the distance is less than 5 times the diameter of the striking face.

5. The hammer of claim 1, wherein the handle is further comprised of a protective plug located at the base of the handle, wherein the internal core is further comprised of a reinforcing block and at least one of a hollow core and a foam core, wherein the reinforcing block is positioned at a mounting end of the handle opposite the base, wherein at least a portion of the mounting end is held within the head substantially perpendicular to the end face, and wherein at least one of the hollow core and the foam core extend from the reinforcing block to the protective plug at the base of the handle.

6. The hammer of claim 1, wherein the head is connected to the handle at the side of the head opposite from the end face by a fastener, wherein the fastener is selected from the group consisting of a set screw, a wedge fit, a wedge fastener, a star nut, a clamp fit, an adhesive and any combination thereof, and wherein the striking face is further comprised of a hard substrate, a malleable striking surface, and an embedded grit, wherein the malleable striking surface is wad of deformable material bonded to the hard substrate, and wherein the embedded grit is formed by a plurality of particles distributed throughout the wad of deformable material.

7. The hammer of claim 1, wherein the head is further comprised of a nail-pull, wherein the nail-pull is comprised of a first notch in a first sidewall of the head and a second notch in a second sidewall of the head, wherein the first notch and second notch are aligned to each other and are offset from a backside of the handle, wherein the first notch engages a head of the nail in a first position, wherein the second notch engages the head of the nail and the first notch engages a shank of the nail in a second position.

8. A hammer, comprising:

a head having a first longitudinal axis, a striking face perpendicular to the first longitudinal axis, a head length extending along the longitudinal axis, and a top having an end face; and a handle connected to the head at a side of the head opposite from the end face, wherein the handle comprises an internal composite layer, an external composite layer, and at least one intermediate composite layer between the internal composite layer and the external composite layer, wherein the handle has a second longitudinal axis substantially perpendicular to the first longitudinal axis, a maximum lateral dimension less than the head length, and a handle length, wherein the head and the handle comprise a total hammer length extending between a base of the handle and the end face of the head and comprise a total hammer weight, wherein a handle weight is between 10%-20% of the total hammer weight, wherein a diameter of the striking face of the head is less than 1.5 times the maximum lateral dimension of the handle, wherein the internal composite layer is formed around an internal core, wherein the internal composite layer and the external composite layer extend the handle length along the second longitudinal axis, wherein the intermediate layer is proximate to the head and extends a length towards the base, and wherein the length is shorter than the handle length.

9. The hammer of claim 8, wherein the hammer has a center of gravity proximate to the end face at a location that is within 85%-95% of the total hammer length.

10. The hammer of claim 8, wherein the total hammer weight is between 0.5 kg and 1.5 kg, wherein the total hammer length is between 13 inches and 20 inches, and wherein the handle weight is between 0.075 kg and 0.15 kg.

11. The hammer of claim 8, wherein a front side of the handle is comprised of a concave outer surface proximate to the base of the handle and an inflection point at an end of the concave outer surface, wherein the inflection point is located a distance away from the base of the handle, and wherein the distance is less than 5 times the diameter of the striking face.

12. The hammer of claim 11, wherein the head is connected to the handle at the side of the head opposite from the end face by a fastener, wherein the fastener is selected from the group consisting of a set screw, a wedge fit, a wedge fastener, a star nut, a clamp fit, an adhesive and any combination thereof, and wherein the striking face is comprised of a hard substrate, a malleable striking surface, and an embedded grit, wherein the malleable striking surface is wad of deformable material bonded to the hard substrate, and wherein the embedded grit is formed by a plurality of particles distributed throughout the wad of deformable material.

13. The hammer of claim 11, wherein the head is further comprised of a magnet insert, and wherein the magnet insert is affixed to a side of the head.

14. The hammer of claim 8, wherein the handle is further comprised of a protective plug located at the base of the handle, wherein the internal core is comprised of a reinforcing block and at least one of a hollow core and a foam core, wherein the reinforcing block is positioned at a mounting end of the handle opposite the base, wherein at least a portion of the mounting end is held within the head substantially perpendicular to the end face, and wherein at least one of the hollow core and the foam core extend from the reinforcing block to the protective plug at the base of the handle.

15. A hammer, comprising:

a head having a first longitudinal axis, a striking face perpendicular to the first longitudinal axis, a head length extending along a longitudinal axis, and a top having an end face, wherein the striking face is further comprised of a hard substrate, a malleable striking surface, and an embedded grit within the malleable striking surface, and wherein the malleable striking surface is bonded to and is deformable relative to the hard substrate; and a handle connected to the head at a side of the head opposite from the end face, wherein the handle has a second longitudinal axis substantially perpendicular to the first longitudinal axis, a maximum lateral dimension less than the head length, and a handle length, wherein the head and the handle comprise a total hammer length extending between a base of the handle and the end face of the head, wherein a diameter of the striking face of the head is less than 1.5 times the maximum lateral dimension of the handle, wherein a front side of the handle is comprised of a concave outer surface proximate to the base of the handle and an inflection point at an end of the concave outer surface, wherein the inflection point is located a distance away from the base of the handle, and wherein the distance is less than 5 times the diameter of the striking face.

16. The hammer of claim 15, wherein the hammer has a center of gravity proximate to the end face at a location that is within 85%-95% of the total hammer length, wherein the total hammer length is between 13 inches and 20 inches, and wherein a total hammer weight is between 0.5 kg and 1.5 kg.

17. The hammer of claim 15, wherein the total hammer length is between 13 inches and 20 inches, wherein a total hammer weight is between 0.5 kg and 1.5 kg, and wherein the handle weight is between 0.075 kg and 0.15 kg, and wherein the distance of the inflection point away from the base is less than 4 times the diameter of the striking face.

18. The hammer of claim 15, wherein the handle weight is between 10%-20% of the total hammer weight, and wherein the handle is made from at least one of a composite material, a metal material, a plastic material, and a wood material.

19. The hammer of claim 15, wherein the handle comprises an internal composite layer, an external composite layer, and at least one intermediate composite layer between the internal composite layer and the external composite layer, wherein the internal composite layer is formed around an internal core, and wherein the internal composite layer and the external composite layer extend the handle length along the second longitudinal axis, wherein the intermediate layer is proximate to the head and extends a length towards the base, and wherein the length is shorter than the handle length.

20. The hammer of claim 15, wherein the malleable striking surface is a wad of material welded onto the hard substrate, wherein the embedded grit is comprised of particles distributed throughout the wad of material, and wherein the malleable striking surface further comprises a mushroom shape.

* * * * *